US005456076A

United States Patent [19]

Zornes

[11] Patent Number: 5,456,076

[45] Date of Patent: Oct. 10, 1995

[54] BALANCED COMPOUND ENGINE

[75] Inventor: Bruce L. Zornes, Bothell, Wash.

[73] Assignee: Balanced Engines, Inc., Tacoma, Wash.

[21] Appl. No.: 270,407

[22] Filed: Jul. 5, 1994

Related U.S. Application Data

[63] Continuation of Ser. No. 879,493, May 6, 1992, abandoned.

[51] Int. Cl.[6] ..... F01B 29/10

[52] U.S. Cl. ..... 60/525; 60/526; 91/218

[58] Field of Search ..... 60/520, 525, 526, 60/527; 91/218

[56] References Cited

U.S. PATENT DOCUMENTS

| | | | |
|---|---|---|---|
| 3,126,348 | 3/1964 | Meijer | 60/526 |
| 3,319,416 | 5/1967 | Renshaw | 60/525 |
| 4,191,019 | 3/1980 | Bratt et al. | 60/525 |
| 4,199,945 | 4/1980 | Finkelstein | 60/525 X |

FOREIGN PATENT DOCUMENTS

| | | | |
|---|---|---|---|
| 1012133 | 7/1957 | Germany | 60/526 |
| 1528118 | 10/1978 | United Kingdom | 60/525 |

*Primary Examiner*—Edward K. Look
*Assistant Examiner*—Hoang Nguyen
*Attorney, Agent, or Firm*—Seed and Berry

[57] ABSTRACT

A balanced compound, regenerative cycle, external heat source engine is mad by using mechanically double acting rigidly affixed and self-aligned reciprocating opposed piston and cylinder structure in which substantially all of the energy created during reciprocating motion is converted or translated into rotational motion by the action of a scotch yoke type, transfer lubricated, sliding/roller bearing mechanism which acts on a single and centrally located crankshaft which is contained in a telescopic crankcase structure. A balanced compound engine structure may be constructed so that two or more subsystems are housed in one or more modules. Two or more power modules may then be coupled together and an engine power and speed control may be attained by varying the relative phase angle of the couple.

21 Claims, 37 Drawing Sheets

Forces $\Gamma := 1.406$ ... analysis for air $Pm := 500 \cdot psi$ $$p(\theta) := Pm \cdot \left[\frac{Vav}{Vt(\theta)}\right]^{\Gamma}$$

*Figure 10*

$p1(\theta) := p(\theta)$
$p2(\theta) := p(\theta + \Phi)$
$p3(\theta) := p(\theta - \Phi)$
$p4(\theta) := p(\theta + \alpha)$ x's -- $a(\theta) := Ao \cdot (p1(\theta) - p4(\theta)) + Ai \cdot (p3(\theta) - p2(\theta))$
+'s -- $b(\theta) := Ao \cdot (p2(\theta) - p3(\theta)) + Ai \cdot (p3(\theta) - p2(\theta))$
box -- $d(\theta) := Ai \cdot (p4(\theta) - p1(\theta))$
dimd -- $d(\theta) := Ai \cdot (p4(\theta) - p1(\theta))$ $$mtot(\theta) := \begin{bmatrix} Ro \cdot \sin(\theta) \cdot a(\theta) + Ro \cdot \sin(\theta + \Phi) \cdot b(\theta) \ldots \\ + Ri \cdot \sin(\theta) \cdot c(\theta) + Ri \cdot \sin(\theta + \Phi) \cdot d(\theta) \end{bmatrix}$$

$\omega := 30\ Hz$ $$\tau := \omega \cdot \left[\int_0^{2 \cdot \pi} mtot(\theta)\, d\theta\right]$$

Torque (hp) estimate
$\tau \cdot hp^{-1} = 301.188$ line -- $h(\theta) := mtot(\theta) \cdot in^{-1}$ $Hi := 40000\ lbf$ $Lo := -Hi$ XPOVO
Piston assembly forces versus Crank angle $\theta$

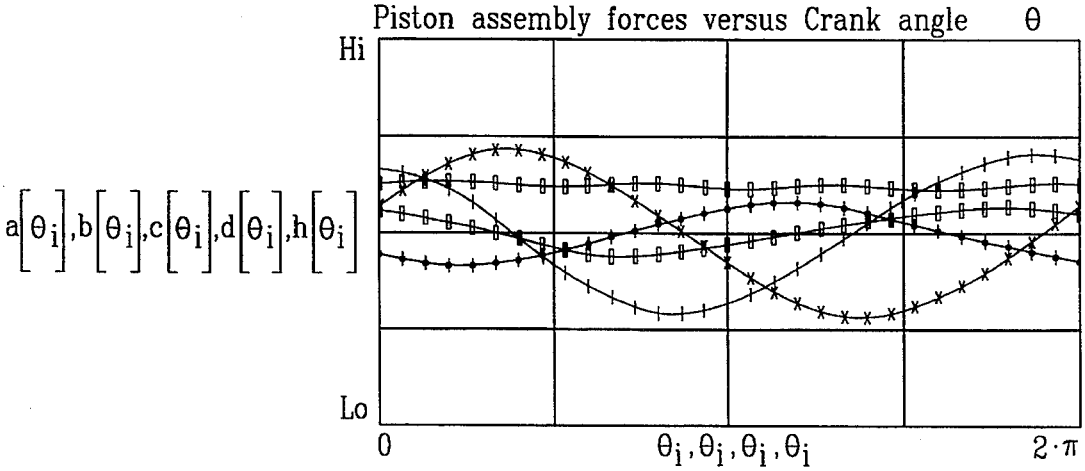

Stirling Analysis – Force/moment balance
failure analysis – 01 Baseline

Constants $Ri := 1.3 \cdot in$ $Ro := 1.1 \cdot in$ $Di := 5.0 \cdot in$ $Do := 7.5 \cdot in$ $Ai := Area(Di)$ $Ao := Area(Do)$ $Ai \cdot in^{-2} = 19.635$ $Ao \cdot in^{-2} = 44.179$ $\alpha := 90 \cdot deg$ Scmidt phase angle between PM's $\Phi := 180 \cdot deg$ Crankpin–to–crankpin angle $Vc := 200 \cdot in^3$ Equations $F(\theta) := 1 - \cos(\theta)$ $Vi(\theta) := (Ai \cdot (Ri \cdot F(\theta - \alpha) + Ro \cdot F(\theta + \alpha))) \cdot in^{-3}$ $Vo(\theta) := Ao \cdot Ro \cdot F(\theta) \cdot in^{-3}$ $Vt(\theta) := Vi(\theta + \Phi) + Vo(\theta) + Vc \cdot in^{-3}$ $imax := 30$ $i := 0 .. imax$ $ifac := \frac{360.}{imax}$ $\theta_i := i \cdot ifac\ deg$

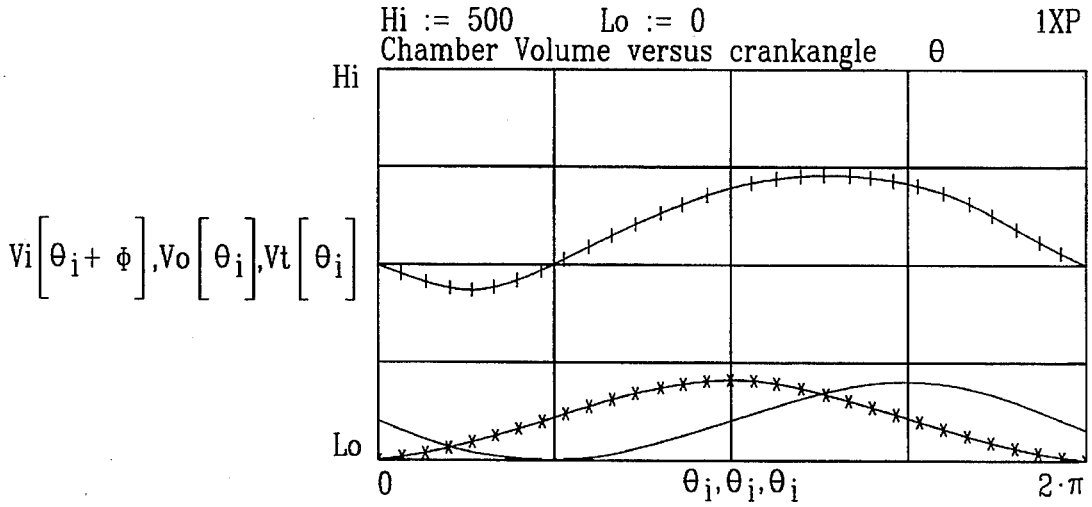

$$Vav := \frac{1}{2 \cdot \pi} \cdot \int_0^{2 \cdot \pi} Vt(\theta)\, d\theta \qquad Vav = 295.72$$

*Figure 11*

Volumetric considerations

The power piston displacement leads the displacer piston movement by a Schmidt phase angle of $\Phi$. This value is ideally 90 deg for maximum power. The total volume as a function of $\theta$, $\Phi$ is determined by:

$i := 1 ..20 \qquad \theta := 10 \cdot (i - 1)$ Crank angle 0 to 200 deg $$Vdis(i,\Phi) := Ao \cdot Ro \cdot \left[1 + \cos\left[\left[\theta_i + \Phi\right] \cdot deg\right]\right] \cdot cuin$$

|__Schmidt phase angle $$Vpwr(i,\alpha) := Ai \cdot \left[Ri \cdot \left[1 - \cos\left[\theta \cdot deg\right]\right] + Ro \cdot \left[1 + \cos\left[\left[\theta - \alpha\right] \cdot deg\right]\right]\right] \cdot cuin$$

|__Crankshaft ip1 to ip2

$$V(i,\Phi) := Vpwr(i,\pi) + Vdis(i,\Phi) + Vi \cdot cuin$$

|__Volume of heat exchanger and associated ducts

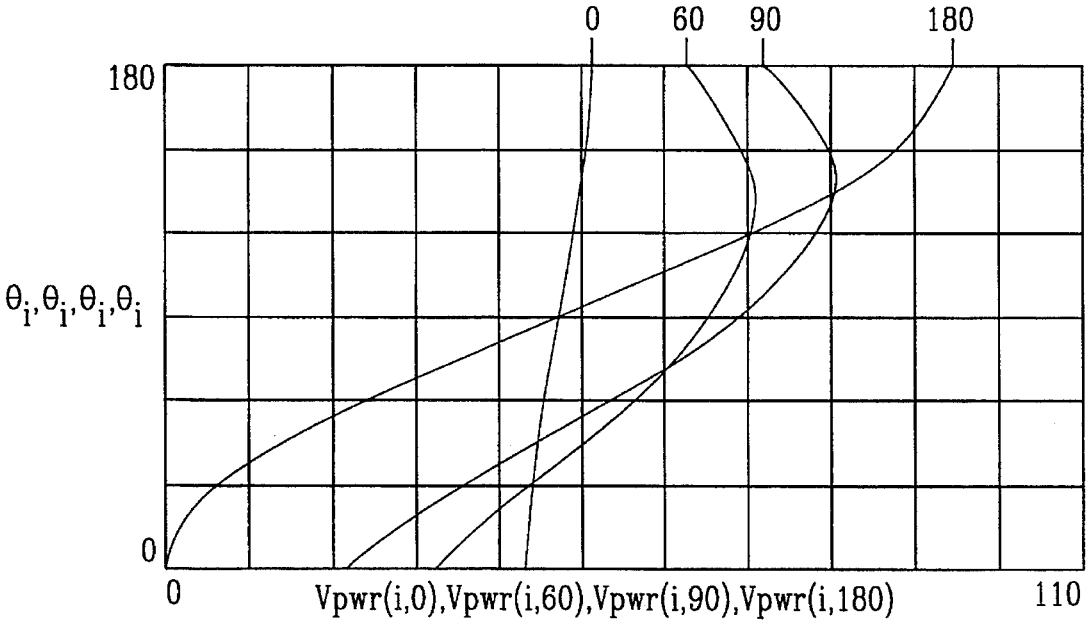

*Figure 12*

BALANCED COMPOUND ENGINE

CROSS-REFERENCE TO RELATED APPLICATION

This application is a continuation of U.S. patent application Ser. No. 07/879,493, filed May 6, 1992, now abandoned.

TECHNICAL FIELD

The present invention relates to Stirling motors of the compound type.

BACKGROUND OF THE INVENTION

The basic principal of the Stirling external combustion engine is simple, being no more than the tendency of a contained gas working fluid to expand or increase in pressure when heat energy is added and to contract or decrease in pressure as energy is removed from the contained gas working fluid. Useful power is derived from the difference of heat input and heat rejection less frictional, inertial, and other losses. Stirling engine structure which uses a regenerative heat exchange system is a heat pump operated in reverse. Any available heat source can be applied to the Stirling heat pump and converted into useful mechanical energy.

Previous investigators in Stirling machine research proposed the concept of balanced compounding in 1978. The Stirling cycle is one example of a general class of regenerative cycle external heat source engines. The principal of the balanced compound machine would integrate four alpha subsystems into parallel opposed cylinder geometry consisting of four double acting opposed reciprocating pistons in two pairs such that each piston pair controls two expansion spaces phased 180 degrees apart. It is important to note here that "double acting" as referred to by Stirling literature refers to the action of the pressure on either or both sides of a piston face; whereas the term "double acting" applied to other mechanical mechanisms describes the nature of the motion of two opposed piston faces which move away from or alternately toward each other during any reciprocating stroke cycle which causes a volume change in a given cylindrical space relative to a common cylinder axis.

A brief description of the Stirling engine cycle and the three main classifications of Stirling engines based on mechanical differences is briefly outlined below. The well known Stirling cycle as related to reciprocating piston engines comprises:

- by means of piston movement some of the gas is transferred back and forth between the hot space and the cold space;
- when more of the gas is in the hot space the pressure rises and is caused to work against a piston face;
- the pressure falls as expansion stroke of the power piston occurs back to the cold space of the displacer;
- the power piston is caused to return in a compressive stroke when some of the gas has been moved back into the cold space of the displacer and the pressure has fallen;
- because the pressure is lower, the force on the power piston is less on its inward compressive stroke than it was during the outward expansive movement so that a net amount of work is gained from the total cycle.

SUMMARY OF THE INVENTION

The balanced compound principal as proposed by investigators in Stirling engine development (ca. 1978) is considered to be the optimum theoretical design in terms of efficiency and power for four integrated "alpha" Stirling subsystems but a lack of suitable design concepts for mechanisms has prevented the realization of a balanced compound alpha Stirling type engine. An investigation of prior art discloses that no previously existing designs function as balanced compound external combustion Stirling engines.

A primary objective of this invention is to provide a novel modular structure which allows a family of engines based on a balanced compound principal for both internal combustion diesel and gasoline engines and external heat source regenerative engine such as the Stirling cycle. This invention yet further discloses a solid-lubricated telescopic crankcase structure such that a high degree of commonalty in the engine crankcase structure exists, both in the internal combustion and external heat source reciprocating piston engine designs. Three examples of balanced compound engines are described in this invention which share a basic commonalty of structure. This invention teaches that a balanced compound engine can be constructed of power modules whereby each power module comprises a telescopic crankcase structure enclosing a pair of solid lubricated and interpenetrating scotch yoke frames acting on a single crankshaft assembly, said crankshaft assembly comprising a set of solid lubricated track roller bearing acting on a central crankpin and a pair of adjoining crankpins, said crankshaft being supported along the said crankshaft journals and substantially aligned by a pair of precision machined bearing caps attached to said telescopic crankcase structure; a pair of outer crankcase extension structures are attached to said telescopic crankcase and enclose a pair of reciprocating interpenetrating and opposed double-acting piston bodies which are attached to said scotch yoke frames; said pair of piston assemblies acting in a pair of opposed cylinders, and said cylinders may be stationary and affixed to the crankcase extensions or alternatively said cylinders may be attached to one of the reciprocating piston bodies thus forming a reciprocating sleeve reciprocating in said crankcase extension structure.

The first example of a modular engine described in this invention is a balanced compound alpha configuration Stirling engine, designed and constructed from a pair of specifically interconnected and phased power modules such that said engine can be operated efficiently with air as the gas working fluid, said engine can operate for long lifetime without oil lubrication over a wide range of speed and load conditions in any physical orientation, said engine can generate a very high torque at the power output shaft, said engine exhibits a nearly constant always positive instantaneous mechanical momemement about the crankshaft axis similar to a low speed turbine engine, said engine is nearly free of vibration, and said engine can exhibit a very high thermodynamic efficiency, a very high specific power output, and be maintenance free for approximately 20,000 or more hours of continuous operation under full load duty cycle.

A second example of a modular engine is described in this invention which is a beta configuration comprising at least one power module using a 90 degree offset crankshaft. The balanced compound beta configuration regenerative external heat source engine as described by this invention uses two specifically interconnected and phased beta configured power modules and can also operate similar to the alpha configured engine described above with a relatively constant and always positive, instantaneous mechanical moment about the power output shaft. The volumetric efficiency of the beta configuration is less than the alpha configuration described above but has less contained volume of gas working fluid and higher safety factor.

The third example of a modular engine is described in this invention and further discloses a novel compounding technology herein termed "combustion compounding" whereby an internal combustion reciprocating piston engine such as a diesel engine also constructed from a power module structure, is directly coupled with a specific phase relationship at the power output shaft to a beta configured regenerative external heat source reciprocating piston engine power module and further the waste exhaust heat from the internal combustion engine is directly supplied as the source of thermal energy to said external heat source engine.

The above mentioned combustion compound diesel engine, alpha configured and beta configured Stirling engines can use identical telescopic crankcases and associated components thus significantly reducing the cost, maintenance, and logistical supply of engine parts.

The annexed drawings and the following description set forth in detail certain means and modes of carrying out the parts of the invention, such disclosed means and mode illustrating of various ways in which the principle of the invention may be used.

BRIEF DESCRIPTION OF THE DRAWINGS

FIG. 10 is graph of the four piston assemblies in the two power modules of the engine of FIGS. 6 and illustrates the force vectors acting on the assemblies during operation and the resulting nearly constant moment;

FIG. 11 is a graph of the individual and net volumes as functions of crankshaft rotation angle of a single alpha subsystem contained by two power modules of the engine of FIG. 6 and connecting ducts;

FIG. 12 is a graph of the pressure versus crankangle for all four alpha subsystems of the engine of FIG. 6;

FIGS. 14A –14D are a series of four frames which illustrates the geometric positions which the internal components of completely interconnected balanced compound alpha Stirling engine of FIG. 6 would be in as a function of crank angle at the 0, 30, 60 and 90 degree positions;

DETAILED DESCRIPTION OF THE INVENTION

External combustion or heat production processes for an external heat source engine allows a wide variety of fuel or heat sources to be used. Stirling engines have been demonstrated which operate on multiphase fossil fuels (gasoline, diesel fuel oil, coal tar pitch), solar heat, nuclear (radioactive isotope) heating, combustion of processed oils (vegetable, peanut, etc.), biomass waste products (woodchips, methane), molten salt phase change heat storage, alcohol, propane, and practically any flammable or combustible substance. The emissions from a fossil fuel burning Stirling engine can be much lower in terms of pollutants due to more closely controlled and constant combustion process.

Figure 1:
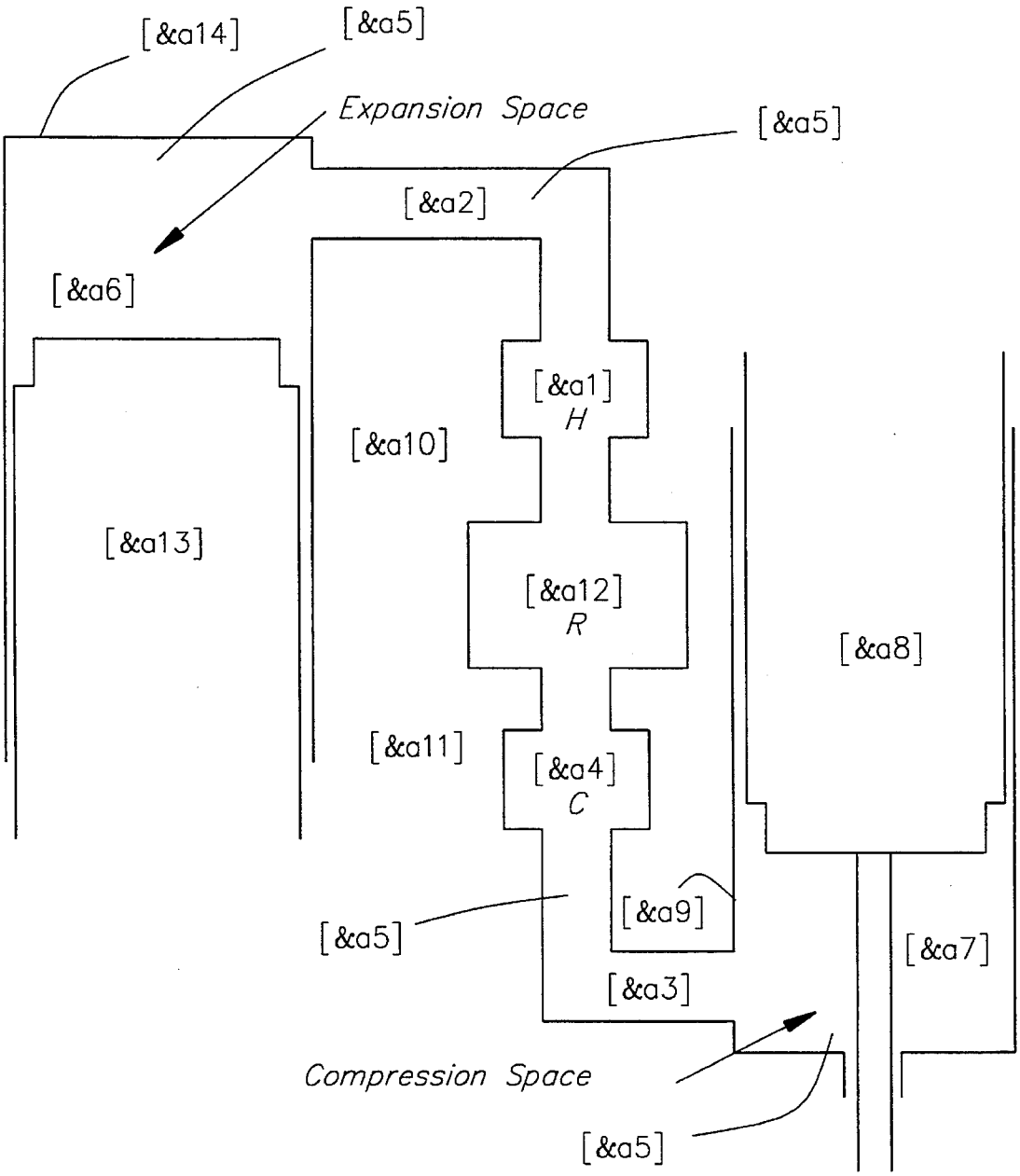
FIG. 1 is a schematic of basic Stirling engine cycle showing the relationship of the displacer piston and power piston to the regenerative thermal management system.

FIG. 1 schematically depicts a basic Stirling engine cycle and at a minimum comprises: a heat source (&a1) supplying heat energy to a hot region (&a2), a heat sink (&a3) removing heat from a cold region (&a4), a thermally conductive gas working fluid (&a5) which transports heat energy between the hot region (&a6) and cold region (&a7), a displacer piston (&a8) reciprocating in a displacer cylinder (&a9) having a hot chamber (&a10) and a cold chamber (&a11), said hot and cold chambers being connected by a thermally insulated regenerative heat exchanger (&a12), a power piston (&a13) reciprocating in a power cylinder (&a14), a means for converting motion of the power output piston (&a13) into useful power such as a rotating crankshaft, and a means for controlling the timing of the movement of the displacer relative to the power piston.

The simplified primary equation describing the ideal power output of a Stirling engine in terms of several parameters is shown below:

$$WO=f*Pm*Vp*(pi/2)*(Ve/Vm)*((Te-Tc)/(Te+Tc))* \sin(phi).$$

Which relates the ideal power output (WO) of the engine to the frequency of shaft rotation (f), mean gas pressure (Pm), power piston swept volume (Vp), displacer expansion volume (Ve), total mean volume averaged over one complete engine cycle and including ducts and flow passageways (Vm), total average temperature differential of the heat source (Te) and sinks (Tc), and Schmidt phase angle (phi) between the movement of the displacer with respect to the power piston. The design goals that can be deduced from this governing equation are as follows: 1) maximize the mean gas pressure (Pm), 2) maximize the swept volume of the power piston (Vp), 3) minimized the total gas displacer volume which includes the volume contribution from the heat exchangers, regenerator, and associated plumbing (Vm), and 4) maximize the temperature differential of the heat source (Te) and sink (Tc).

The gas working fluid in a Stirling engine may be chosen based upon several factors including thermal transport properties, safety, and cost. Air, helium, and hydrogen gases have been demonstrated as useful in several Stirling engine designs. Air is highly desirable from a cost and availability viewpoint, however air has a large molecular weight resulting in larger kinematic viscosity and less thermal conductivity compared to either hydrogen or helium. Air can be successfully used if the bulk flow rate of the air through the various flow passageways is at or below about 10 meters per second. However, an efficient Stirling engine may use air which is moist or contains a certain amount of water vapor due to the fact that moist air exhibits a tenfold increase in thermal conductivity as compared to dry air.

During the gas working fluid transfer process three additional events may occur during the work cycle: 1) heat is added to the gas from a heat exchanger coupled to an external combustion heat source; 2) heat from the gas is elastically stored in and subsequently recovered from a thermal gradient sponge called a regenerator which may consist of open channel porous media through which the gas is bidirectionally forced into and out of; 3) heat is rejected from the gas by means of a heat exchanger and radiator. These three heat management components are physically positioned between the hot and clod spaces of the displacer.

The external combustion or heat source Stirling cycle exhibits a higher efficiency then the conventional internal combustion or heat source Otto and Diesel cycles due to the combined high mean gas pressures and temperature differential and the constant flow external combustion process of a combusted fuel Stirling engine which allows optimized control of the air to fuel ratio as compared to traditional internal combustion engines.

The torque or ability to produce work at the engine power output shaft is inherently high in the Stirling cycle engine and nearly independent of engine shaft speed due to the substantially high mean pressure of the gas working fluid. The Stirling cycle engine is also inherently more smooth and vibration free than the state-of-the-art internal combustion engines due to the lower pressure variation during a complete cycle. The rate of pressure change of internal combustion engines is very rapid causing high peak pressures, especially prevalent in the Diesel engines and high compression ratio turbocharged gasoline engines which results in vibration and shock loads on the engine structure. The magnitude and rates of pressure changes in the Stirling cycle engines are comparatively less.

An investigation into prior art reveals that control of the shaft power output of a Stirling engine is normally accomplished in one of three ways 1) by reducing the heat source temperature (e.g. by reducing the quantity of fuel combusted for a fossil fuel source engine), 2) by reducing the gas pressure by a variable control volume in-line with the displacer, and 3) by varying the swept volume of the power piston by means of gearing, levers, or link and cam action. The first method of varying the heat input causes very sluggish or unresponsive control of the power output due to the inherent thermal inertia of the thermal management devices. The second method of varying the pressure by means of an in-line variable control volume is the most commonly used method, however it results in an increase in the total gas volume and presents difficulties in sealing the high temperature, high pressure gas working fluid. The third method of varying the swept volume of the power piston is considered to be the most desirable by current Stirling researchers however the mechanical mechanisms for causing a varying volume are generally complex and difficult to reliably achieve. A fourth method of engine power control is disclosed in this invention wherein the phase relation between the coupling of two power modules is varied thus effecting engine power control in engine configurations using two or more interconnected power modules as described by this invention.

Three classes or types of Stirling engines are generally recognized which are distinguished by the kinematic and geometric relationship of displacer and power piston motion and coupling. The three classes are called alpha, beta, and gamma, with a fourth category being hybrid combinations of the three classes.

The gamma subsystem is distinguished in that separate cylinders are used to house separate pistons one of which acts as a displacer and the other produces power.

The beta subsystem is similar to the gamma but the displacer and power piston share a common cylinder housing.

The gamma and beta subsystems use separate pistons for the functions of displacement and volume changing whereas the alpha subsystem utilizes the same piston mechanism for multiple functions. Alpha subsystems are arranged in three types as 1) parallel piston, 2) opposed in-line piston, and 3) opposed parallel piston.

In a practical engine gas leakage past the seals of the variable volume chambers will almost always occur. This leakage results in a decrease of the pressure of the contained gas working fluid and a corresponding decrease in engine power according to the relationship described previously in the governing equation. The pressure will decrease corresponding to the leak rate thus requiring a mechanism for supplying and repressurizing the gas lost due to leakage. The leakage of high pressure, high temperature gas into a chamber containing lubricating oil such as the crankcase may also have the highly undesirable effect of causing the lubrication oil to ignite and/or explode, especially if a gas mixture such as air is used which can react with the lubricating oil.

Present state-of-art Stirling engine designs such as the United Stirling 4–95 restrict the engine from operating at crankshaft speeds below approximately 1000 rpm under substantial load due to the inability of the oil lubricated bearing systems to maintain a lubricating film under high bearing loads at slower speeds. This is highly undesirable since one of the attractive features of the Stirling cycle engine is the very high torque available even at very low engine shaft speeds. The engines described in this invention overcome this limitation by using solid or transfer lubricated bearings. This invention teaches that transfer lubricated oil free high load bearing systems can be used in the Stirling engine which allow useful power output to be realized over the full range of engine shaft speeds.

Self-aligned rigidly affixed piston assemblies are accomplished by means of a dowelling system consisting of a collar sleeve and bolt fastener which rigidly affix two structures with recessed holes together and complete the frame of the scotch yoke assembly. Precision alignment of the cylinder bore axes is particularly difficult to achieve over a large separation distance and typically requires one pivot point with two degrees of freedom for each inner and outer piston assembly.

Figure 2:
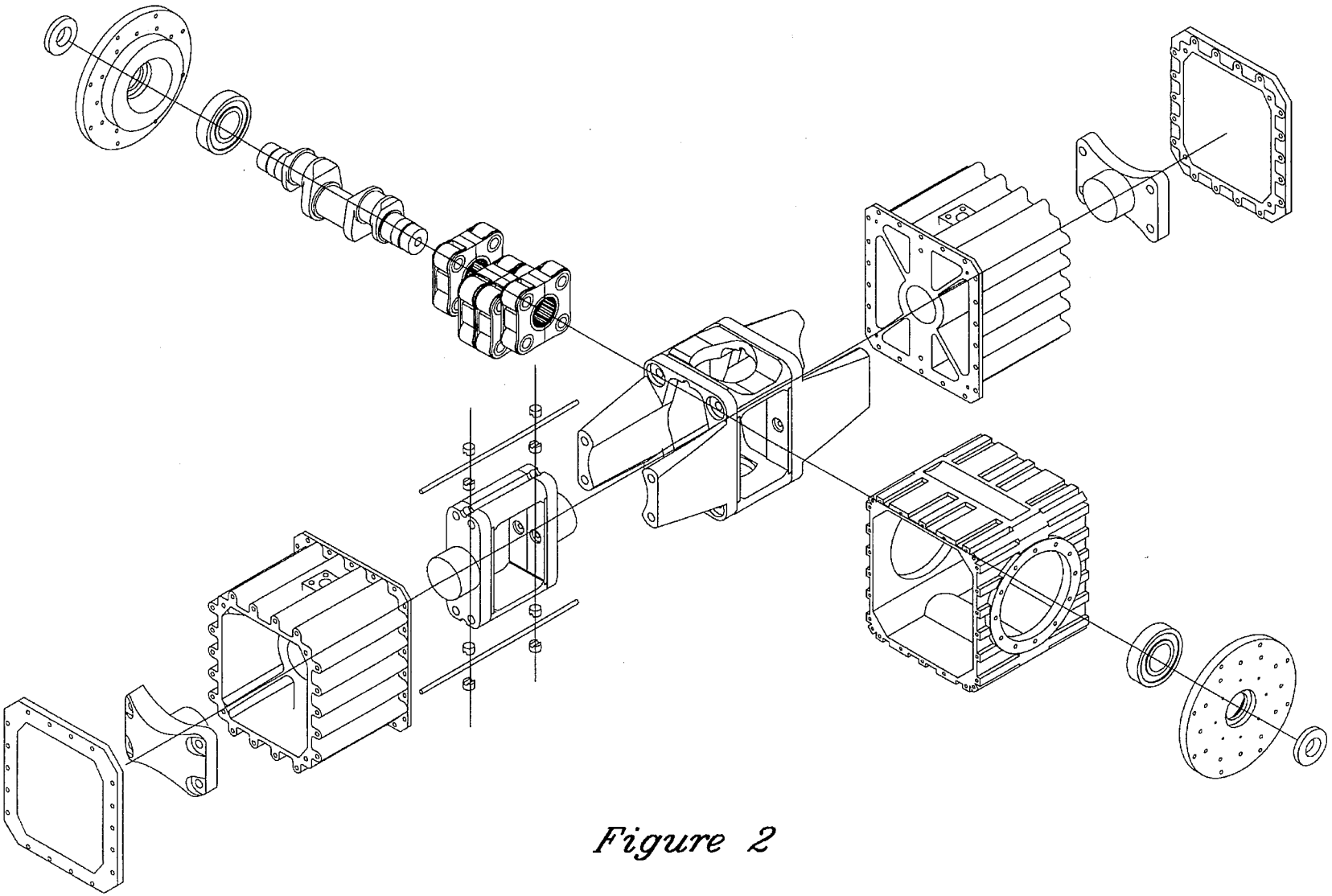
FIG. 2 is an isometric view of the basic components comprising the telescopic crankcase structure used in reciprocating opposed double-acting piston engines.
Figure 3:
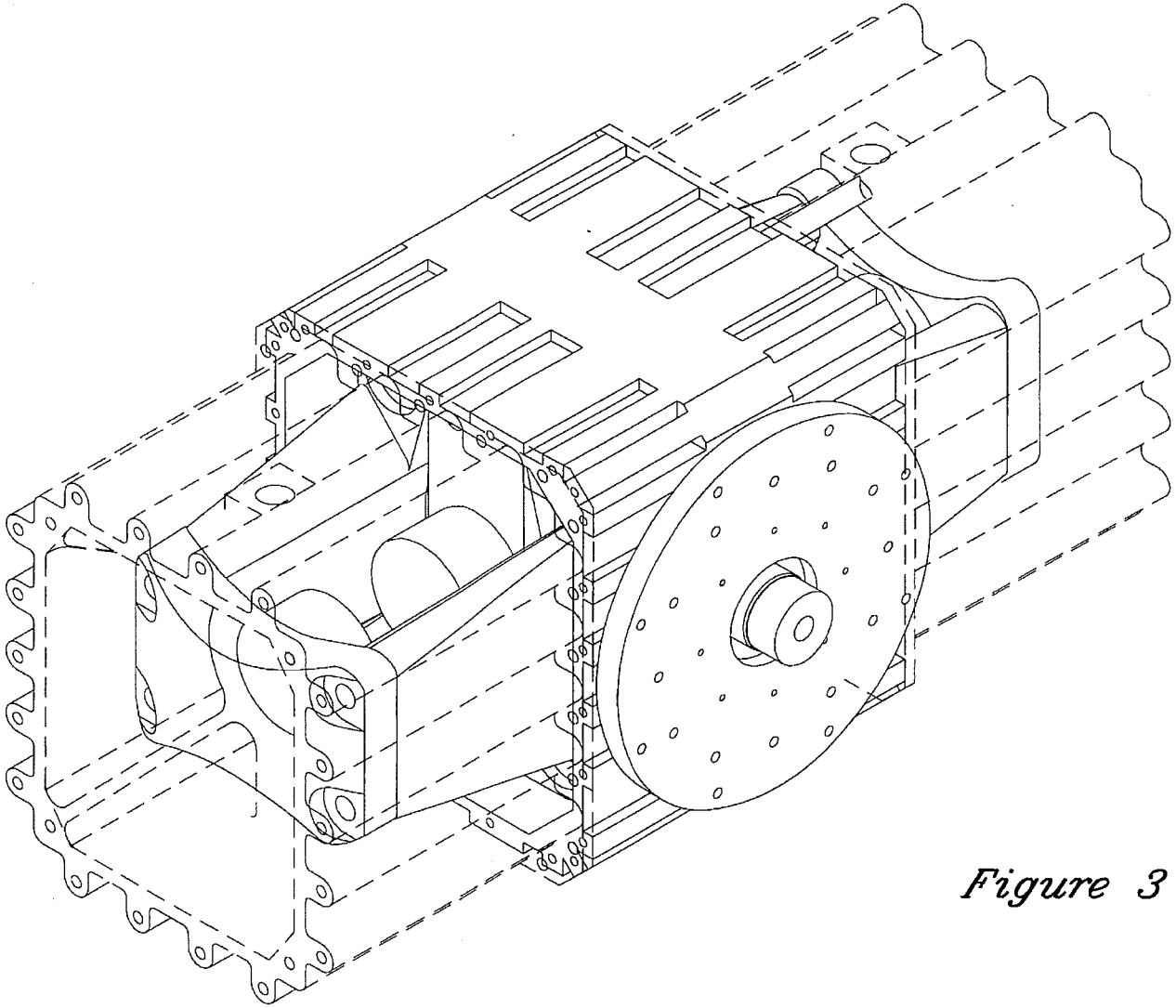
FIGS. 3 and 3A are a section view of the components of FIG. 2 showing the profile of the parts along the center axis.
Figure 3A:
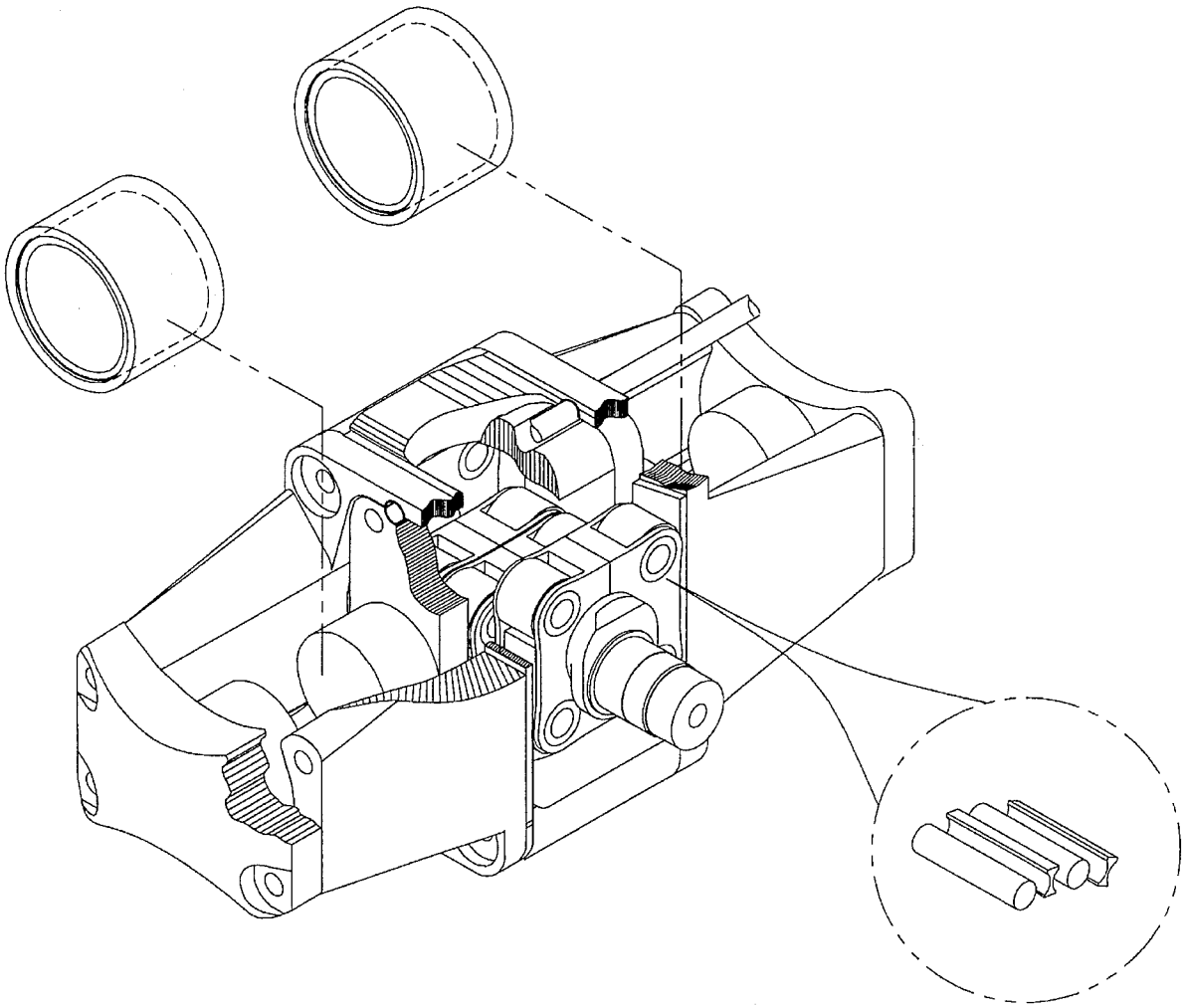
Figure 6:
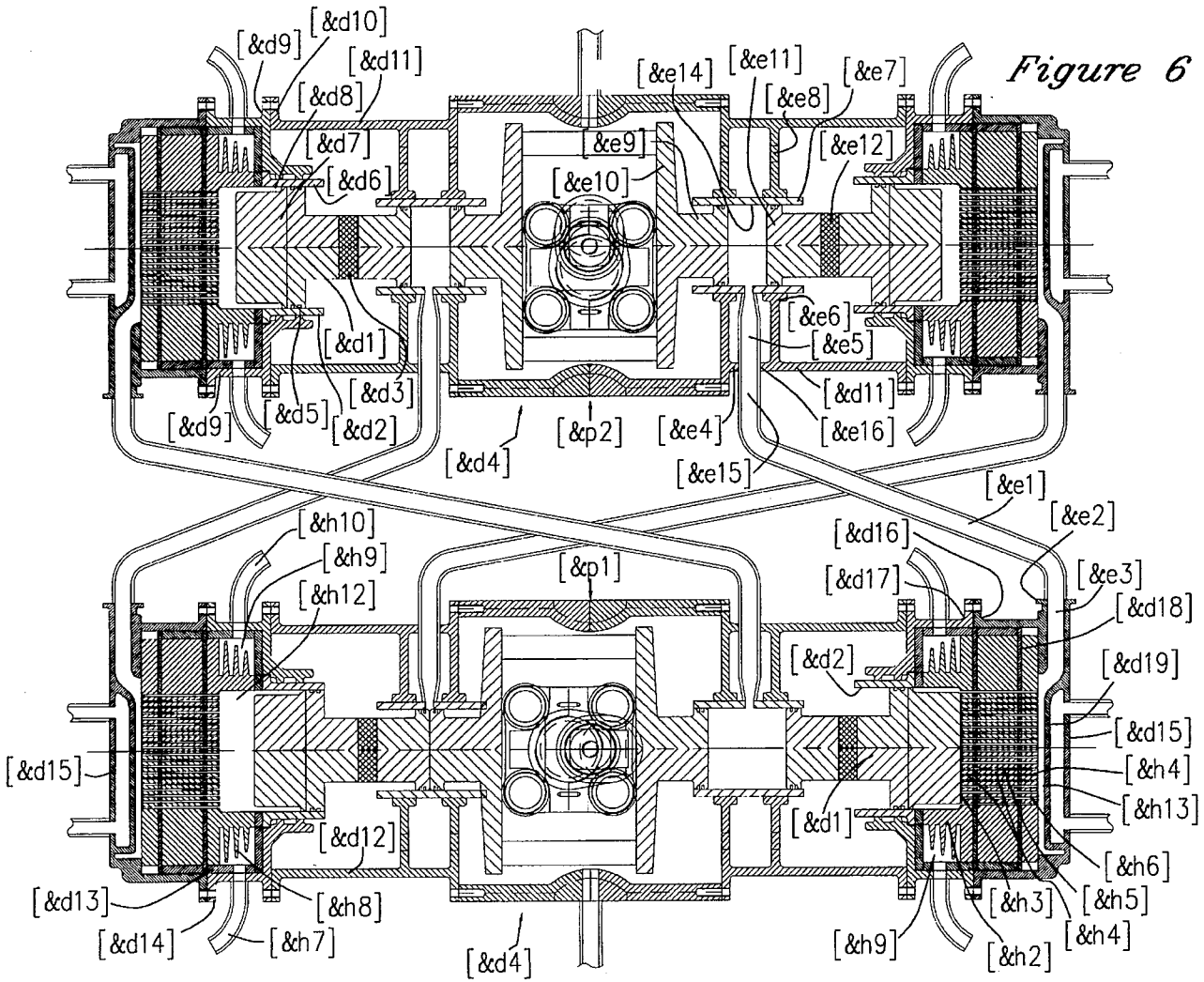
FIG. 6 is a view of two power modules connected and the means for interconnecting four alpha subsystems to make a balanced compound external heat source regenerative engine using two power modules with 180 degree crankshafts.

Referring to FIGS. 2 and 3–3A, power modules can be constructed in accordance with U.S. Pat. No. 5,092,185. The principal concept of this invention uses two interpenetrating opposed piston bodies which reciprocate alternately toward and away from each other about a single crankshaft via a solid lubricated Scotch yoke linkage thus forming four variable volume chambers between which contain a gas working fluid and a hot zone and cold zone are maintained. FIG. 6 illustrates the interconnection of two power modules in an alpha configuration each of said power module contains a pair of reciprocating opposed piston double acting assemblies. The crankshafts of each power module are phased 90 degrees apart while each inner crankpin on a crankshaft is phased 180 degrees from the respective outer pair of crankpins.

Two different engine geometries can be constructed using a common telescopic crankcase. The first is a sleeve valve engine comprising a reciprocating cylinder assembly working in conjunction with a reciprocating piston assembly. The second is a configuration with a fixed cylinder with a reciprocating outer piston assembly working in conjunction with a reciprocating inner piston assembly.

The sleeve valve engine design consists of double acting opposed piston/cylinder mechanisms such that two opposed piston assemblies are rigidly affixed by means of a self aligning dowel system to each other coaxially (hereafter called the "Inner Piston Assembly") and caused to reciprocate, by means of a solid lubricated Scotch yoke acting on a crankshaft assembly which is contained in a telescopic crankcase housing, said inner piston assembly reciprocates within a moveable opposed cylinder pair also rigidly affixed to each other by means of a self-aligning dowel system (hereafter called the "Reciprocating Cylinder Assembly" such that the long cylinder axis of the engine housing structure and the cylinder axis of the Inner Piston Assembly and the cylinder axis of the Reciprocating Cylinder Assembly are all coaxial. Note that the cylinder cross section geometry of the engine house, the Reciprocating cylinder and the Inner Piston Assemblies do not have to be circular. For example: the engine housing cylinder cross section and the matching outer cross section of the Reciprocating Cylinder may be square or polygonal while the inner cross section of the Reciprocating Cylinder and the matching Inner Piston cross section may be circular. The Reciprocating Cylinder Assembly functions as a Stirling displace in that the outer piston face compresses and expands gas contained in the space between this face and the fixed inner face of the engine housing cylinder. Since the piston structure that serves as the displacer is also used to produce power this engine is rightly categorized as a parallel opposed cylinder double action alpha Stirling engine. The scotch yoke crankshaft assembly causes the combined linear reciprocating motions of the Inner Piston Assembly and Reciprocating Cylinder Assembly to be converted into rotational or angular motion.

This engine is similar in kinematic volume change as the engine described in the first example. The mechanism by which the volume changes differs from the first example in that the Reciprocating Cylinder Assembly as such is replaced by a fixed cylinder structure which contains a variable volume which is acted upon by two axially opposed push-pull piston assemblies coupled to a common crankshaft axis so that a given crankshaft rotation causes the two piston assemblies to move substantially opposite (either towards or away from) each other along the same cylinder axis causing an oscillating volume change of the contained volume space. Similar to the Reciprocating Cylinder Assembly of the first example, the opposite face of the outer opposed piston of the engine in this example can also function as the displacer volume space. Thus, the Outer Piston Assembly comprises four pistons supported by a carriage frame also forming the outer Scotch yoke frame assembly, while the Inner Piston Assembly comprises two pistons supported by a structure forming the inner Scotch yoke slider bars.

The principals of the first and second examples described above can be generalized for a multiplicity of volume spaces sharing a common crankshaft such that three or more moving bodies may reciprocate along a cylindrical axis.

This invention teaches that a balanced compound regenerative cycle, external heat source engine can be realized by using mechanically double acting rigidly affixed and self-aligned reciprocating opposed piston and cylinder structure in which substantially all of the energy created during reciprocating motion is converted or translated into rotational motion by the action of scotch yoke type, transfer lubricated, sliding/roller bearing mechanism which acts on a single and centrally located crankshaft which is contained in a telescopic crankcase structure. A balanced compound engine structure may be constructed so that two or more subsystems are housed in one or more modules. Two or more power modules may then be coupled together and a means of engine power and speed control may be attained by varying the relative phase angle of the couple as discussed in the following.

Figure 4:
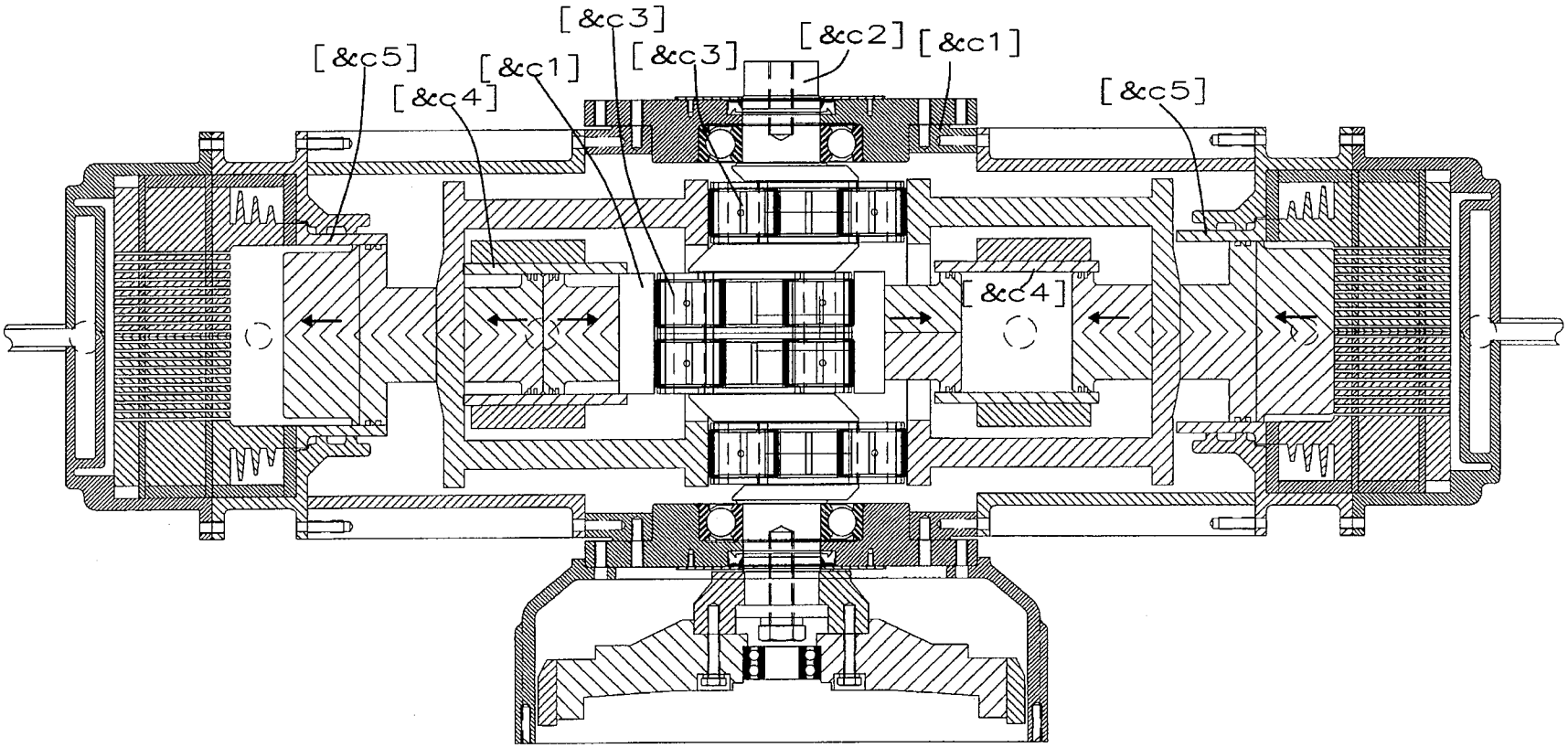
FIG. 4 is a top view of a single power module attached to a flywheel housing and illustrates the major internal components of a power module.
Figure 5:
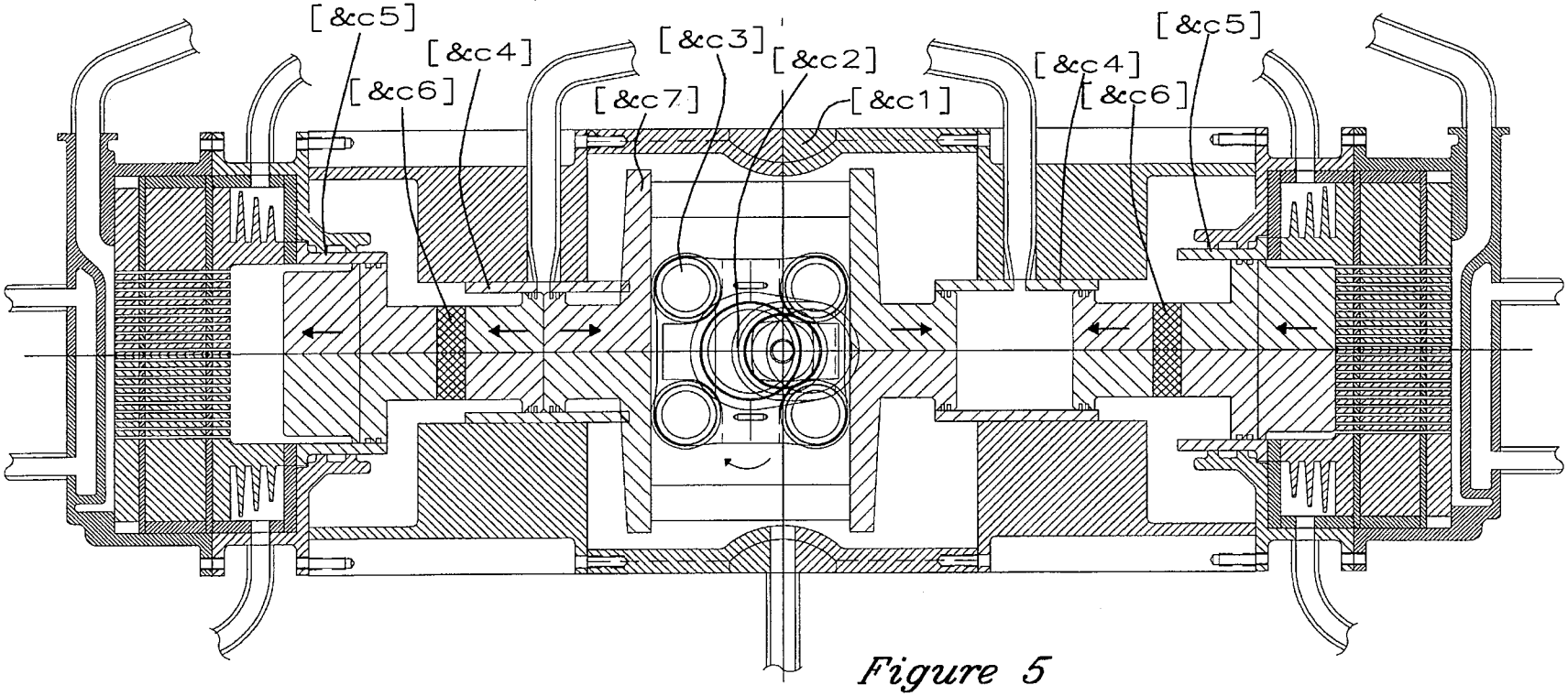
FIG. 5 is a side view of the power module and internal components of FIG. 4.

FIG. 4 depicts a top view and FIG. 5 depicts a side view of the internal working components of a power module. A power module comprises an enclosed crankcase structure [&c1] housing a crankshaft [&c2], two pairs of solid lubricated track roller bearing blocks [&c3], two opposed inner cylinders [&c4], two opposed outer cylinders [&c5], a reciprocating outer piston scotch yoke assembly [&c6], and a reciprocating inner piston scotch yoke assembly [&c7].

FIG. 6 illustrates the major components of two power modules. An outer duct [&e1] is attached to flange [&e2] of the flow orifice [&e3] of said cold cap [&d15]. The other end of said outer duct [&p3] is attached to flange [&e4] located on the outer wall of crankcase extension structure [&d11] of a second power module [&p2]. An inner duct [&e5] is connected to the inner wall [&e6] of said extension structure [&d11] of power module [&p2]. An inner power piston [&e9] is attached to reciprocating inner piston scotch yoke assembly [&e10] of power module [&p2]. An outer power piston [&e11] also reciprocates in said inner cylinder [&c7] and is opposed to said inner power piston [&e9]. Said outer power piston [&e11] is attached to reciprocating outer piston scotch yoke assembly [&e12] of power module [&p2]. A power chamber [&e13] is defined by the inner walls [&c14] of said inner cylinder [&e7] and said reciprocating power pistons [&e9, &e11]. The other end [&e15] of said inner duct [&e5] connects to a ported flange [&e16] on inner cylinder [&e7] thus allowing the inner power chamber [&e13] to communicate through said ducts [&e5, &p3] and said flow passageways contained in cold plate [&h6] housed in cold cap [&d15] on power module [&p1].

The operation of a single alpha subsystem is first described and subsequently the operation of all four alpha subsystems operating in concert will be described to further clarify the balanced compound alpha Stirling engine operation:

The components of a single alpha subsystem are contained by two power modules and are described in detail as follows: In FIG. 6 an outer displacer piston [&d1] reciprocates in an outer cylinder [&d2] and is attached to a reciprocating outer piston scotch yoke assembly [&d3] contained by power module structure [&d4]. Said displacer piston structure [&d1] contains a series of compression rings [&d5] for the purpose of forming a moving gas tight seal with respect to the inner walls [&d6] of said outer cylinder [&d2]. A thermally insulated piston cap [&d7] having an annular clearance gap [&d8] is attached to said outer displacer piston [&d1] for the purpose of reducing heat flow toward the inner components of said power module [&d4]. Said outer cylinder [&d2] is encased in an outer housing structure [&d9] which is attached to flange [&d10] of crankcase extension housing [&d11] of power module [&d4].

Considering a single alpha subsystem: In FIG. 6 gas working fluid flows reversibly in alpha subsytem [&f1] changing direction once for each complete revolution of the power module crankshaft. The gas working fluid for each alpha subsystem is totally contained by the closed but variable volumes bounded by power chamber [&e13] in power module [&p2], inner duct [&e5], duct [&e1] connecting power module [&p2] to power module [&p1], cold chamber [&h13] located in cold cap [&d15], the flow passageways [&h4] of the cold plate [&h6], of the regenerator [&h5], and of the hot plate [&h3], and by hot chamber [&h12] located in power module [&p1]. As the volume is decreased in hot chamber [&h12] by the movement of displacer piston [&d1] toward hot plate [&h3] the pressure increases in said hot chamber [&h12]. When the pressure in the hot chamber exceeds the pressure of the gas in the internal volume of cold cap [&d15], then a pressure differential exists and said gas working fluid is caused to flow from said hot chamber [&h12] and into the connecting flow passageways [&h4] in the regenerator [&h5] and heat energy exchanges from the hot gas to the regenerator material and is locally stored in the mass of the thermally conductive regenerator material. If the regenerator was allowed to directly conduct heat either from the heat source or to the heat sink through supporting structure then appreciable heat gain or loss would occur and the regenerator would fail to locally store and recover heat respectively from and to the gas working fluid. Failure of the regenerator to serve as a thermal barrier separating the hot region from the cold region would substantially reduce the efficiency of the engine since either more heat would be required to be input from the heat source or more heat would be rejected to the heat sink for the same engine power output. This would also cause a thermal short circuiting of the cold plate with respect to the hot plate and cause the engine to suffer substantial reduction in thermal efficiency. As the gas leaves the regenerator it enters the flow passageways contained in the cold plate [&h6], and subsequently the gas is caused to enter into said cold chamber [&h13] and impinge on cold wall [&d19] of cold cap [&d15] whereby thermal energy is transferred from the gas working fluid to the walls of said cold cap and ultimately rejected into the thermal sink. The now cooler gas subsequently flows out of the cold cap orifice [&e3] and through ducts [&e1, &e5] and into said power chamber [&e13]. The gas does work on the power pistons [&e9, &e11] as the gas expands by the increasing stroke travel of the opposed power pistons. After the bottom of the stroke travel the two power pistons [&e9, &e11] come back together, decrease the volume, and subsequently compress the working gas in the power chamber [&e13]. As the gas is compressed the pressure increases and when the pressure in the power chamber [&e13] and connecting ducts [&e1, &e5] then the gas reverses direction and flows back through the ducts, into the cold chamber, and subsequently into is caused to flow from the cold chamber back through the regenerator and into the hot chamber. Heat is again exchanged from the regenerator which is now hotter and to the gas and the previously stored heat is thus locally recovered.

Referring to FIGS. 6, 10, 11, and 12, instantaneous net force acting on the outer piston assembly of power module results from the combination of following four force vectors, the first force arises from pressure of gas working fluid of alpha subsystem in hot chamber acting on the face of displace piston and combines with the second force which arises from pressure of gas working fluid of alpha subsystem in power chamber acting on small outer power piston face, to work against third force which arises from pressure of gas working fluid of alpha subsystem in hot chamber acting on displacer piston face and fourth force which arises from pressure of gas working fluid of alpha subsystem in power chamber acting on small outer power piston face. If the net force acts in the direction of outer piston assembly travel then work is done on the crankshaft and net instantaneous power at the shaft output is increased. Conversely, if the net force acts against the direction of said piston assembly travel then the crankshaft does work on the piston assembly and net instantaneous power at the shaft output is decreased for said power module.

The combination if these forces acting on the respective piston assemblies is depicted in FIG. 10. The assumption of adiabatic conditions for the purpose of analysis is made to derive a functional relationship, with respect to crankshaft rotation angle, of the instantaneous pressure of the gas working fluid existing in the respective alpha or beta subsystems.

FIG. 11 is a graph of the individual and net volumes as functions of crankshaft rotation angle of a single alpha subsystem contained by two power modules of the engine of FIG. 6 and connecting ducts.

FIG. 12 is a graph of the pressure versus crankangle for all four alpha subsystems of the engine of FIG. 6.

The engines described in this invention are novel in that all reciprocating piston components, both displacer and power piston assemblies in the case of the external heat source engines, generate power and add to the net torque output of the crankshaft at some or all points during crankshaft rotation in the engine operating cycle. Inertial losses are minimized in that while energy is stored in a reciprocating assembly as it is being accelerated or changing direction, during another rotation angle in the cycle the energy is being recovered, less frictional losses which are not recoverable. The engines described in this invention can be balanced so that a flywheel is not required except to support a ring gear for conventional starting motor engagement. The interpenetrating reciprocating bodies act as means for inertial energy storage and recovery while simultaneously contributing to rotational motion of the crankshaft.

Figure 7:
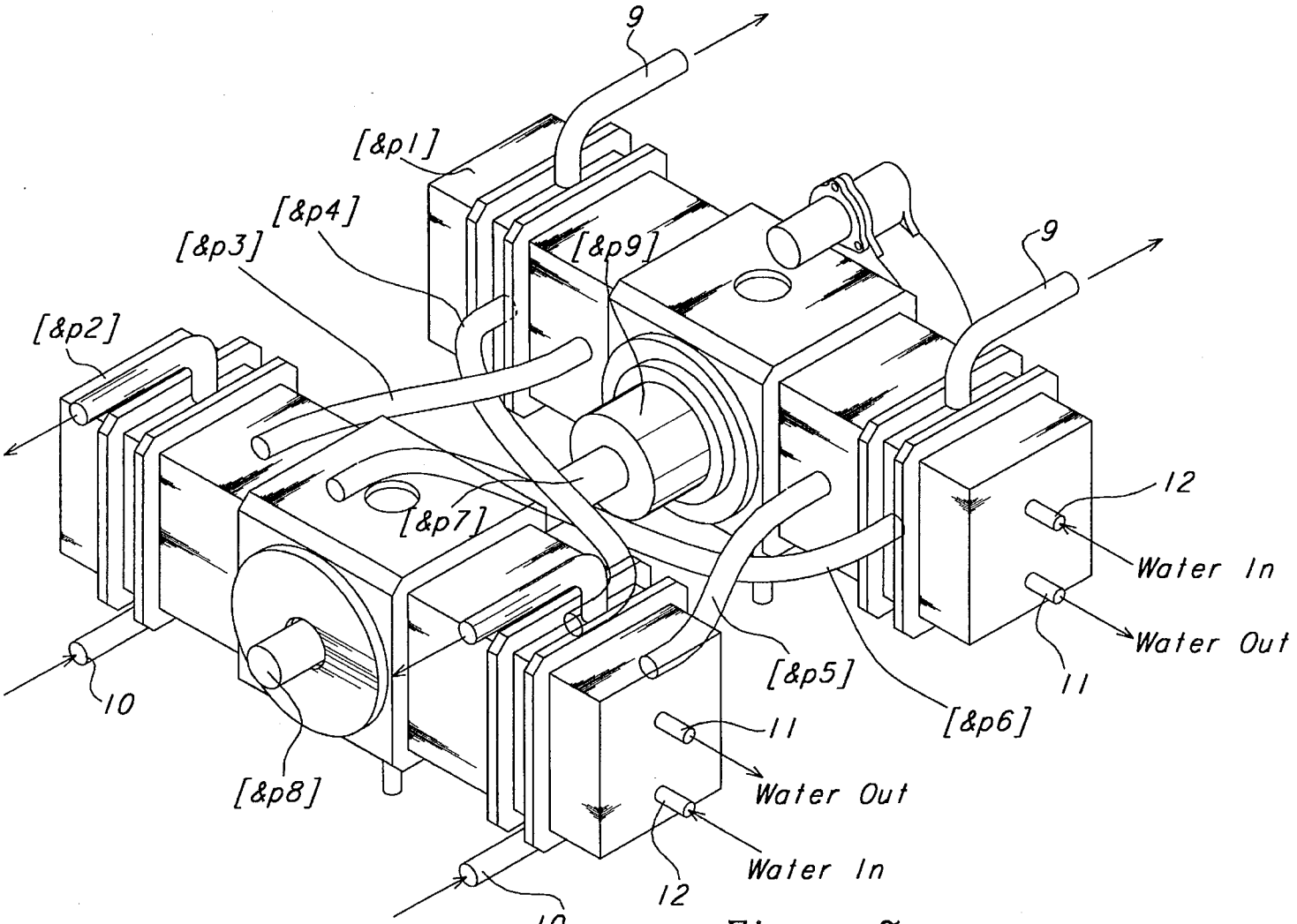
FIG. 7 is an isometric view of two power modules connected as a balanced compound alpha Stirling engine illustrating the external packaging and interconnecting ducts.

FIG. 7 is an isometric view which illustrates the external interconnection of two power modules to form a balanced compound alpha Stirling engine. A balanced compound alpha Stirling engine is constructed from two power module structures [&p1, &p2] which are interconnected by four separated ducts [&p3, &p4, &p5, &p6] and said power modules [&p1, &p2] are coupled together at the crankshaft ends [&p7, &p8] by a variable Schmidt phase angle controller [&p9]. One power module [&p1] contains one-half of each of four distinct alpha Stirling subsystems and the other power module [&p2] contains the respective mating components of each of the four alpha subsystems. The power modules are coupled such that the crankshafts rotate in the same direction and that one complete rotation is accomplished in both crankshafts at the same time.

Figure 8:
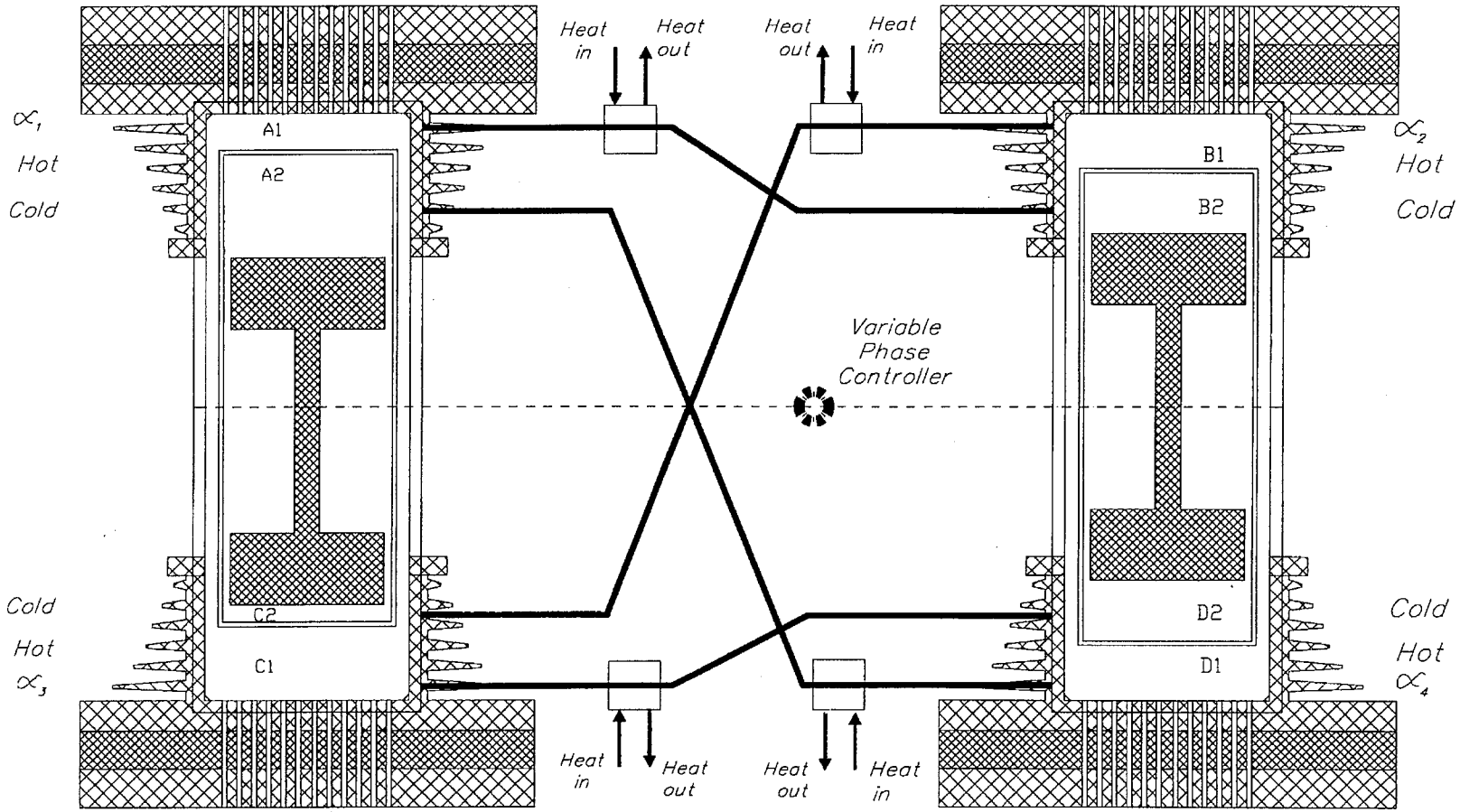
FIG. 8 is a schematic of the means for interconnecting four alpha subsystems to make a balanced compound external heat source regenerative engine using two power modules with 180 degree crankshafts and Schmidt phase control.

FIG. 8 is a schematic of the means for inteconnecting four alpha subsystems to make a balanced compound external heat source regenerative engine using two power modules with 180 degree crankshafts and Schmidt phase control.

The four integrated alpha subsystems (balanced compound) Stirling machine illustrated in FIGS. 6 and 8 is constructed of two identical power modules whereby each module is comprised of a single Inner Piston Assembly, a Reciprocating Cylinder Assembly, a scotch yoke crankshaft assembly, and bearings which are housed in a suitable (split crankcase) structure for a total of six moving parts in each module housing (the Inner Piston Assembly, the Reciprocating Cylinder Assembly, three Slider bearing assemblies and the crankshaft). The two said modules are coupled at their respective output shafts by means of a phase control device. Each of the four alpha subsystems are phased 90 degrees apart when the variable phase couple between the two modules is set at 90 degrees. When the Schmidt phase control is changed to some angle other than 90 degrees the alpha subsystem halves A1 and C1 remain exactly 180 degrees apart and the alpha subsystem halves B1 and D1 remain exactly 180 degrees apart as determines by the respective module crankshafts.

Heat Exchanger Operation in Engine

This invention teaches that a regenerative external heat source engine can be designed to operate with air as the gas working fluid, said engine design uses stacked alternating layer heat exchanger design with large cross-sectional orifice area allowing low flow rates to be achieved.

In the preferred embodiment of this invention the heat source is thermal energy available from combustion process of fossil fuel which results in gaseous hot combustion products.

Heat Exchangers can be constructed in accordance with U.S. Pat. No. 4,901,787. FIG. 6 illustrates the heat exchanger system [&h1] and is comprised of the following: A cylindrical intermediate hot structure [&h2] fabricated from a thermally conductive material forms part of the heat input heat exchanger. Said intermediate hot structure [&h2] adjoins a hot plate [&h3] containing flow passageways [&h4], a thermally insulated regenerator [&h5] also containing flow passageways [&h4], a cold plate [&h6] also containing flow passageways [&h4], a means for adding heat from the thermal source to the hot structure [&h2, &h3] and a means for removing heat from the cold plate [&h6] to the thermal sink. One embodiment of this invention illustrates a means for adding heat to the hot structure [&h2, &h3] and consists of hot combustion products from an external [&h2, &h3] and consists of hot combustion products from an external combustor entering heat inlet [&h7], subsequently flowing around the heat fins [&h8] of hot structure [&h2] for the purpose of enhancing heat transfer from the external heat source, through the walls of said hot structure, and into the gas working fluid contained in hot chamber [&h12]. The intermediate hot structure [&h2] and the heat input hot plate [&h3] of the heat exchange system are both contained by said outer housing structure [&d12] of power module [&d4]. A layer of thermal insulating material such as zircoina [&d13] is attached to the inner walls [&d14] of said heat chamber structure [&h9] to prevent thermal loss into the interior components of the crankcase. A cold cap [&d15] contains a cold wall [&d19] directly spaced opposite from the flow passageways of the cold plate [&h6]. A cold chamber [&h13] is defined as the internal volume of the cold cap [&d15] bounded between the cold plate [&h6] and the cold wall [&d19]. Said cold cap [&d15] is attached by flange [&d16] to the outer flange [&d17] of said outer housing structure [&d12]. A thermally insulated spacer ring [&d18] is adjoined to the outer end [&d19] of said outer cylinder [&d2] and adjoined to the other side of said spacer ring [&d18] is said intermediate hot structure [&h2].

This invention teaches that an ideal quaternary symmetric balanced compound Stirling engine can be constructed of four alpha configured subsystems which are housed in two power modules with a common Schmidt phase angle feedback loop engine power controller coupling the two modules via their respective crankshaft which typically may share but are not necessarily constrained to a common axis.

Phase Angle Loop Control

This invention also teaches that a novel method of controlling the Stirling engine, by a variable 'Schmidt phase angle' direct feedback loop, is possible due to the unique geometry of the Stirling engines as described in this invention.

FIG. 8 is a schematic of the means for interconnecting four alpha subsystems to make a balanced compound external heat source regenerative engine using two power modules with 180 degree crankshafts and Schmidt phase control.

Figure 9:
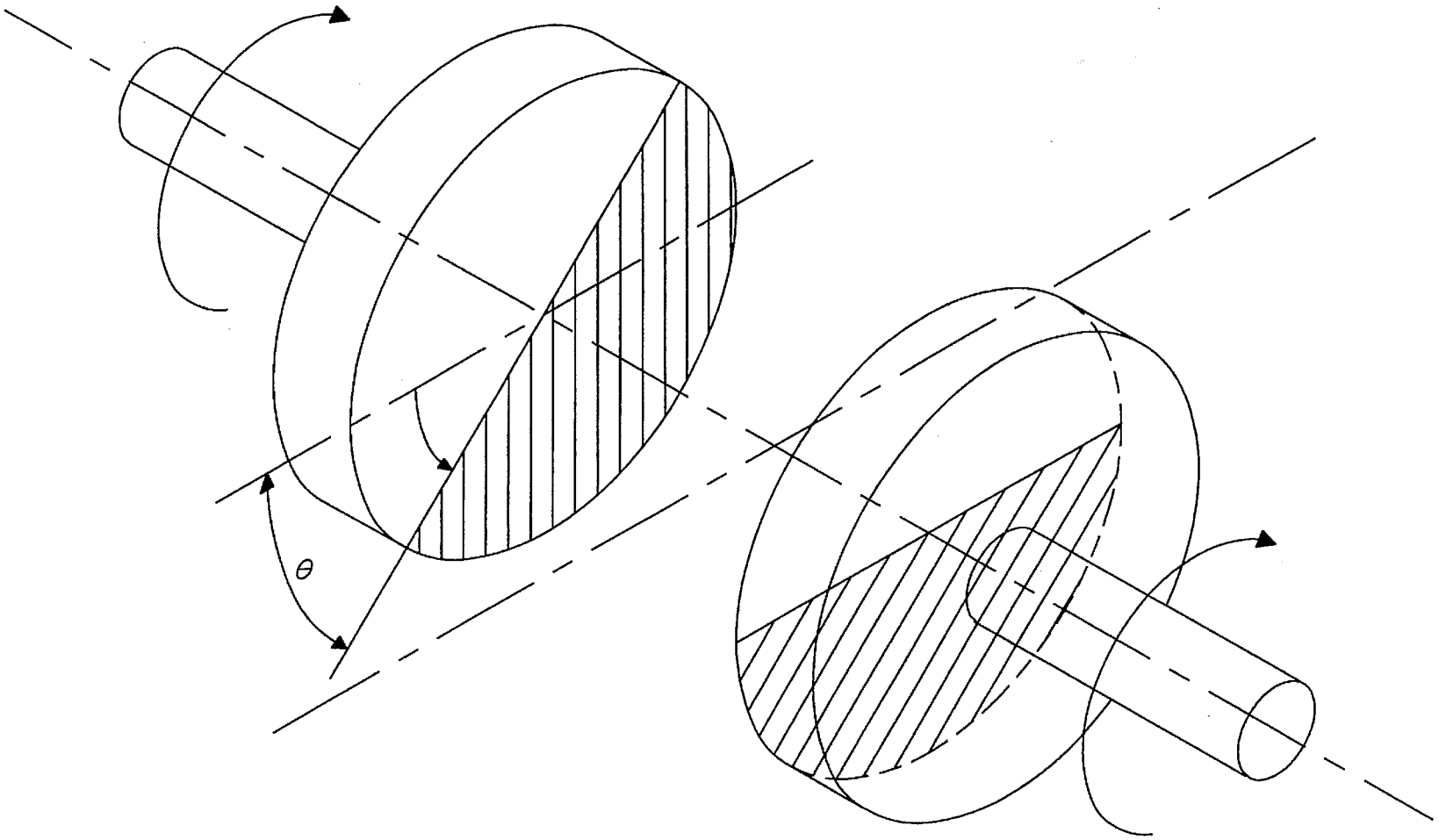
FIG. 9 schematically illustrates a means of alpha engine control by varying the Schmidt phase angle.
Figure 13A:
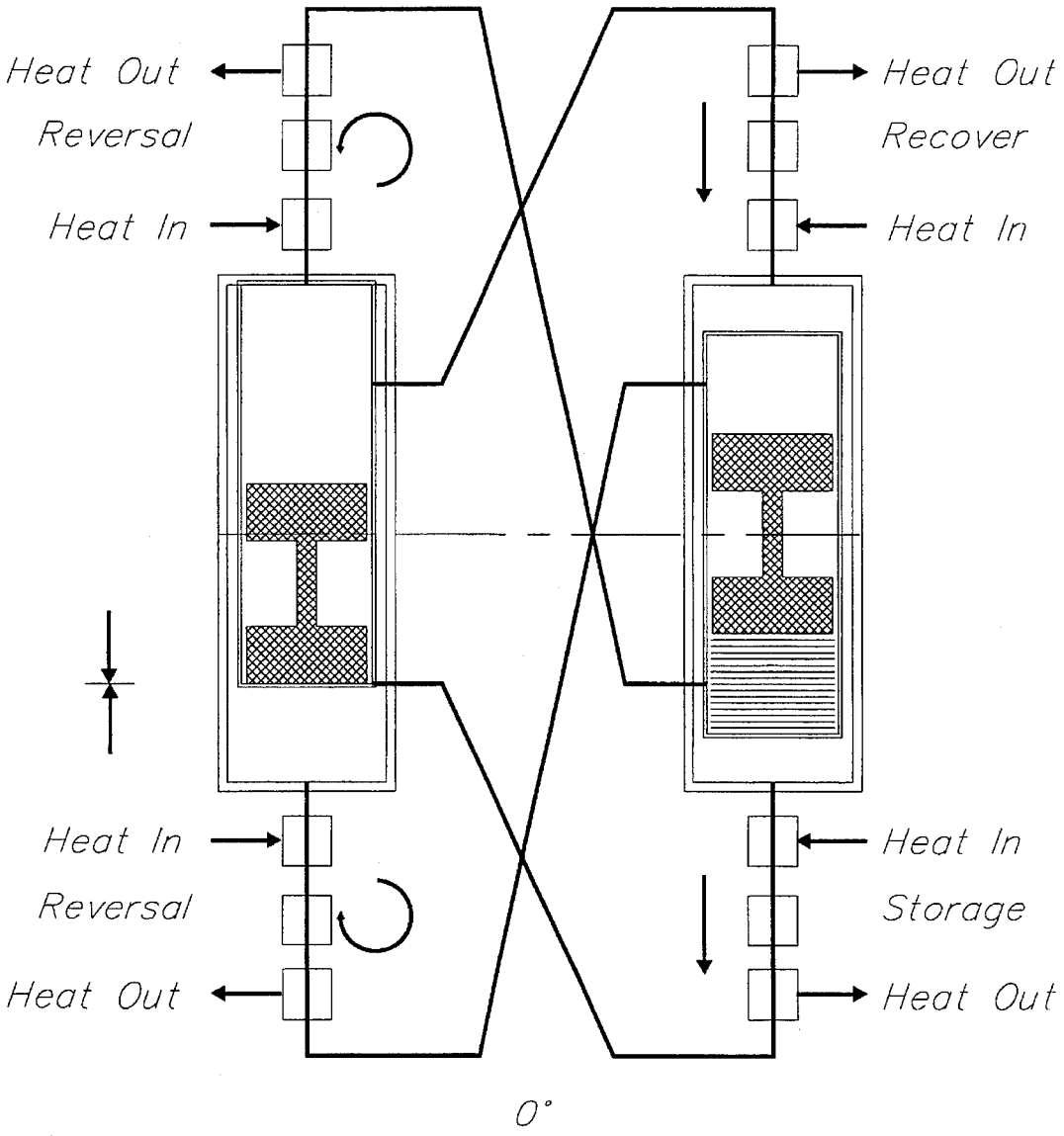
FIGS. 13A –13L are a series of 12 sequential frames which schematically represent the engine of FIG. 6 and depicts the major events and interpenetrating component positions through a complete crankshaft rotation cycle.
Figure 13B:
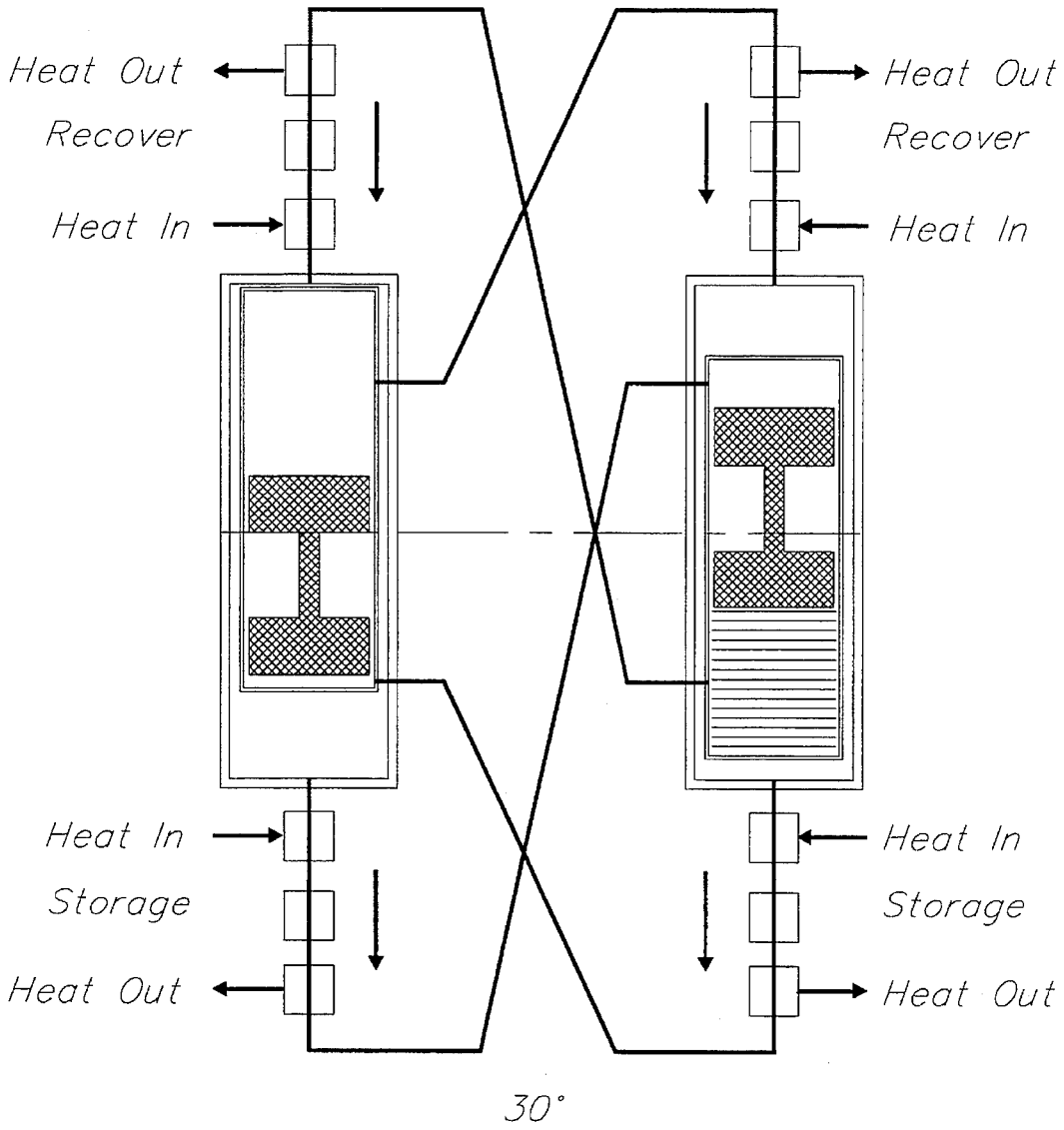
Figure 13C:
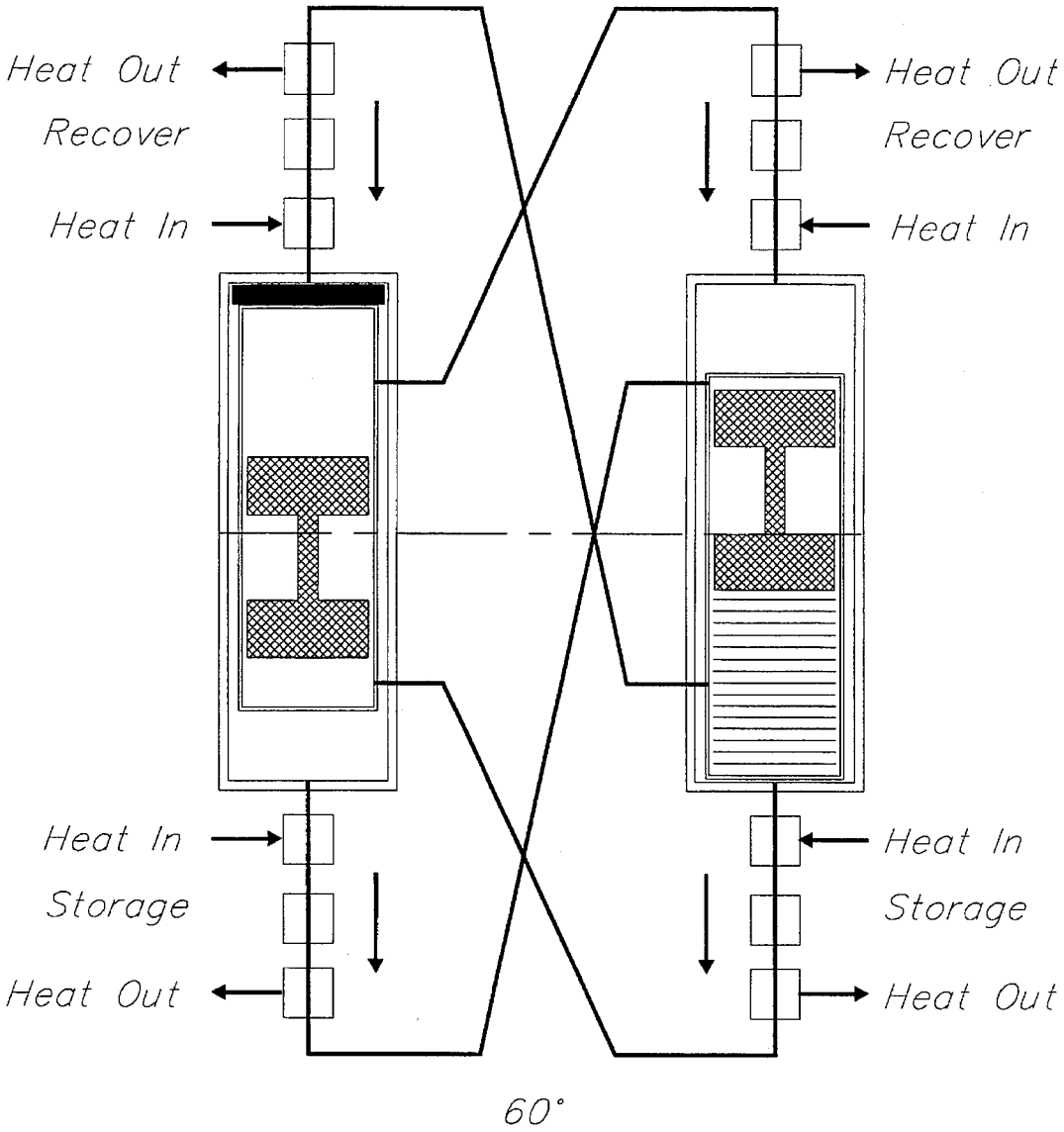
Figure 13D:
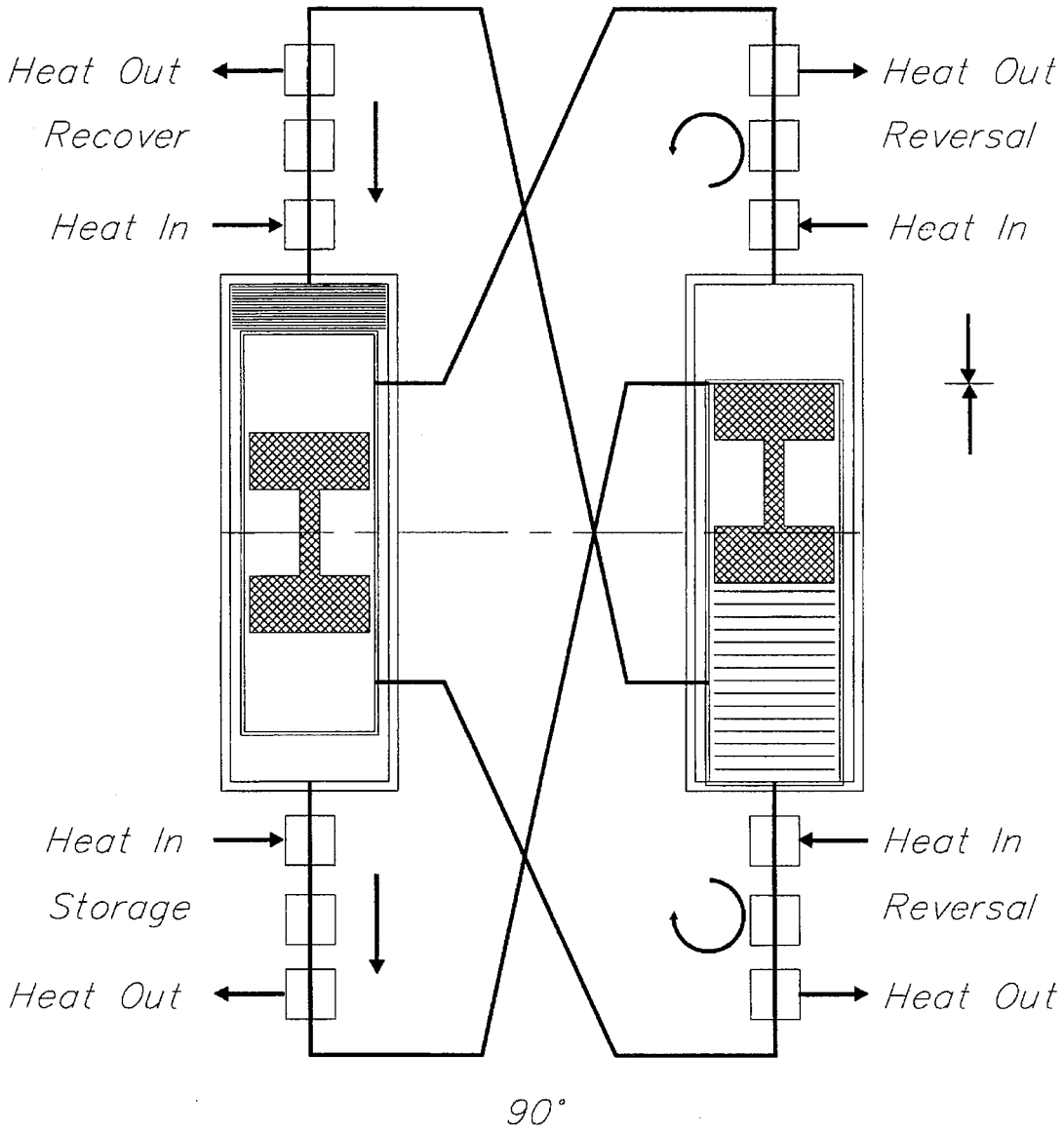
Figure 13E:
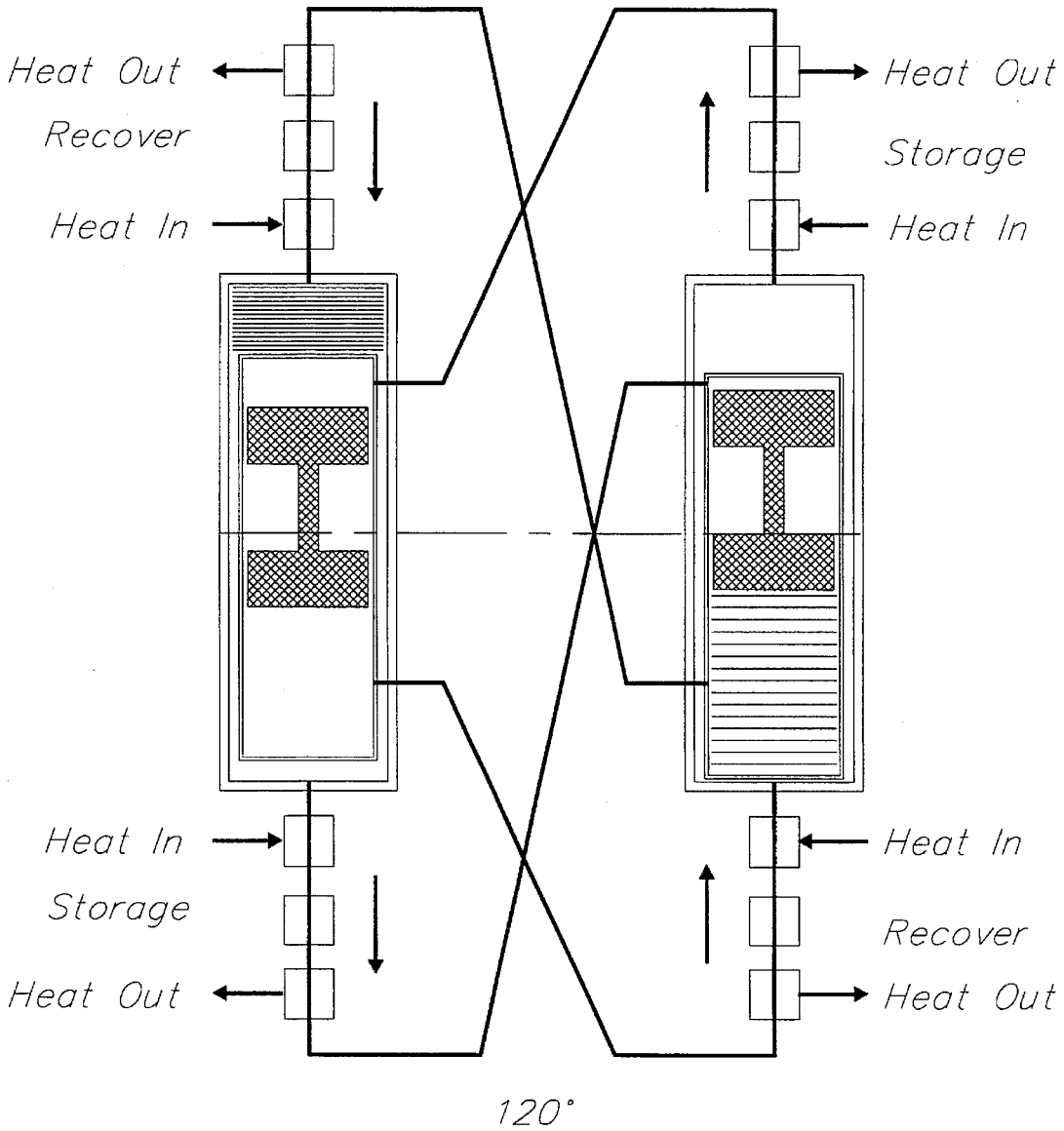
Figure 13F:
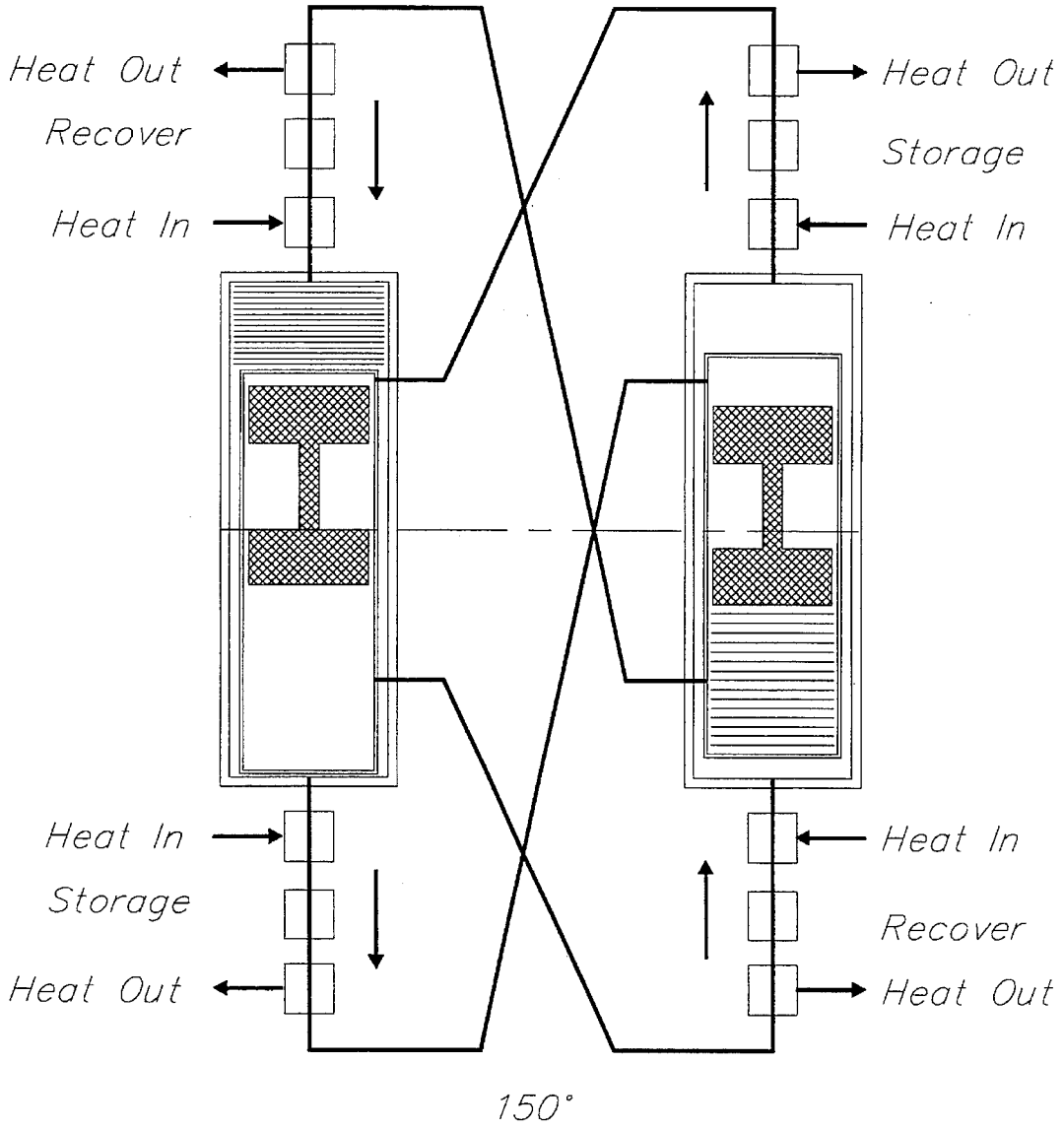
Figure 13G:
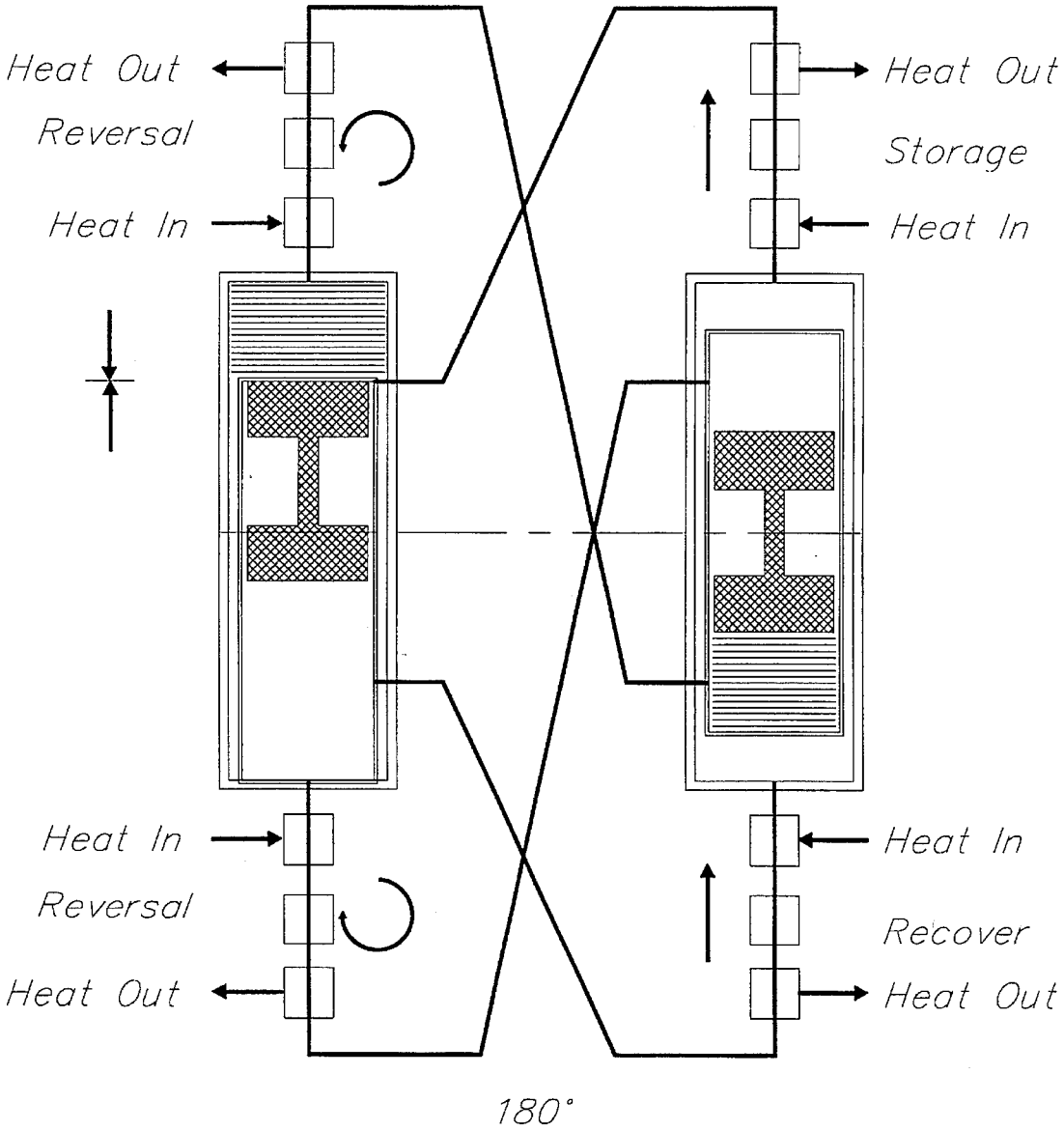
Figure 13H:
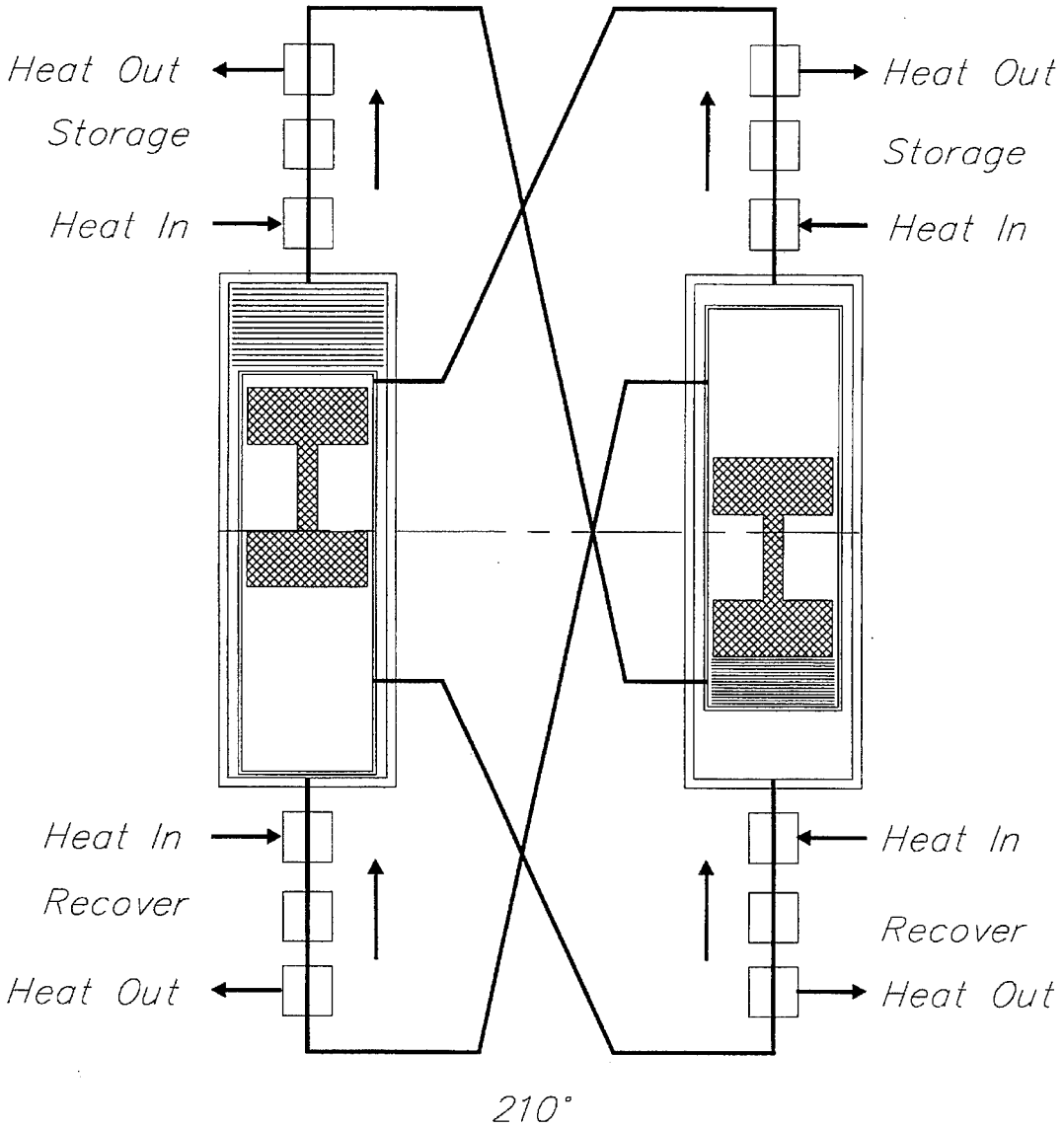
Figure 13I:
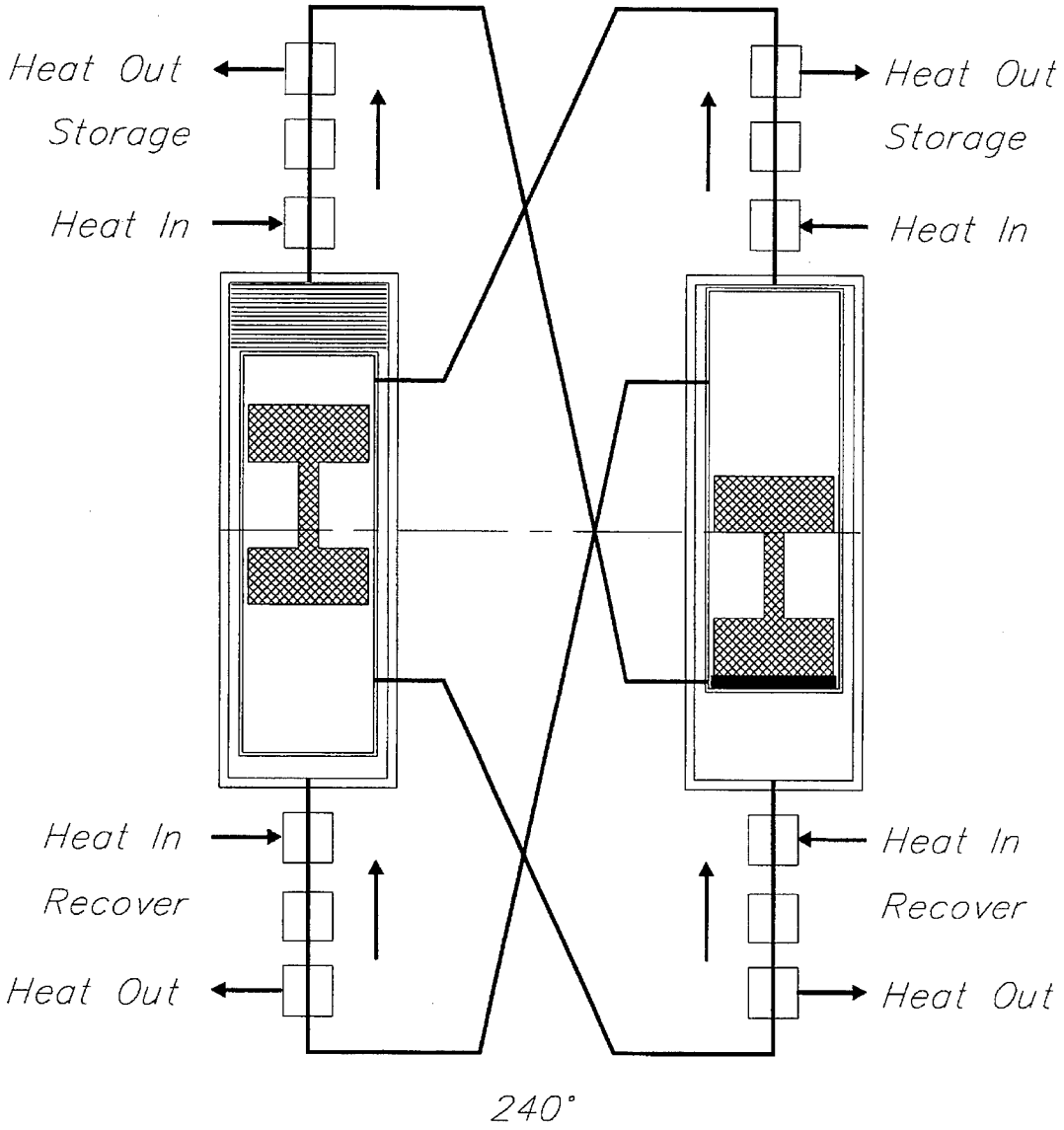
Figure 13J:
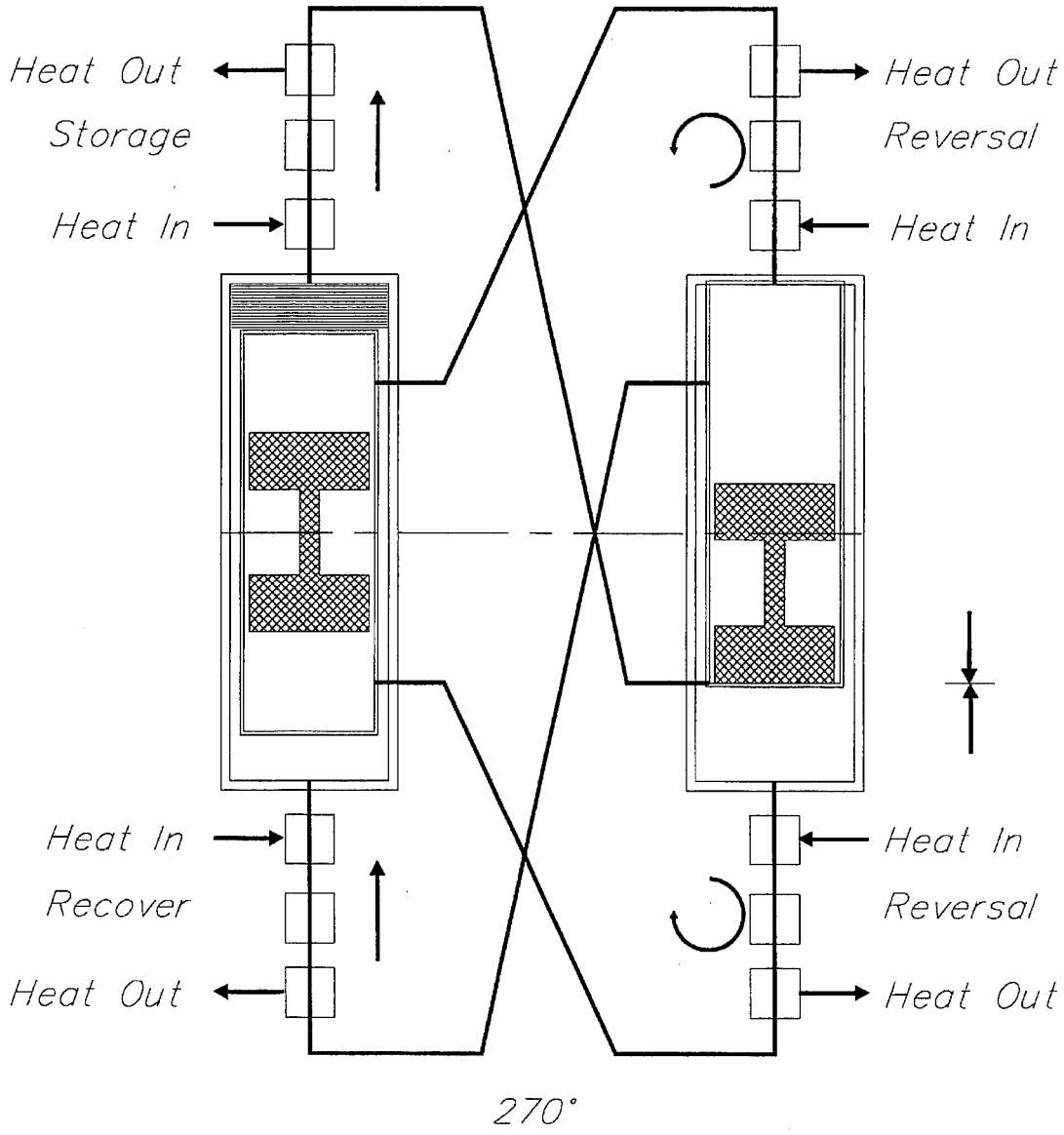
Figure 13K:
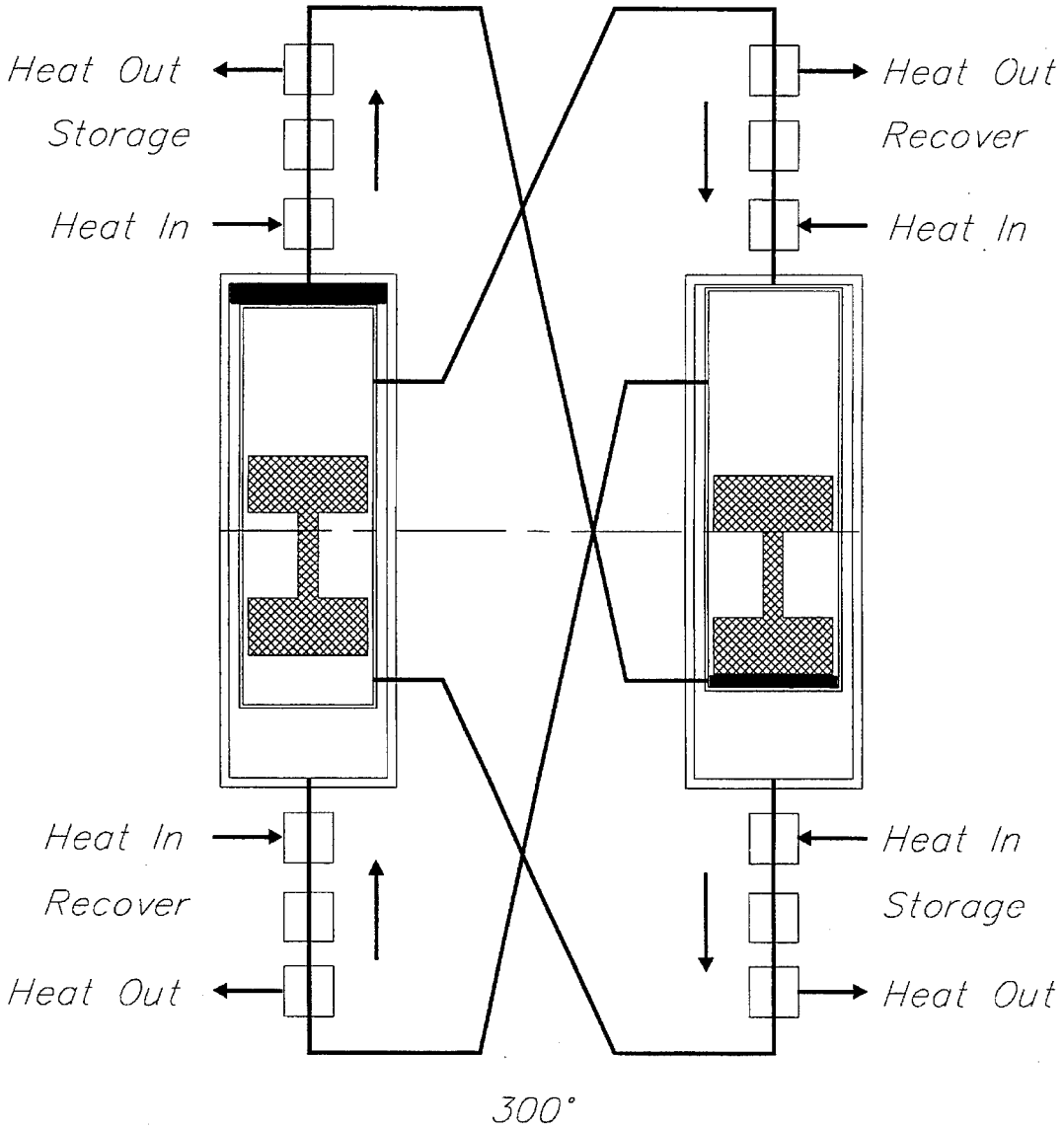
Figure 13L:
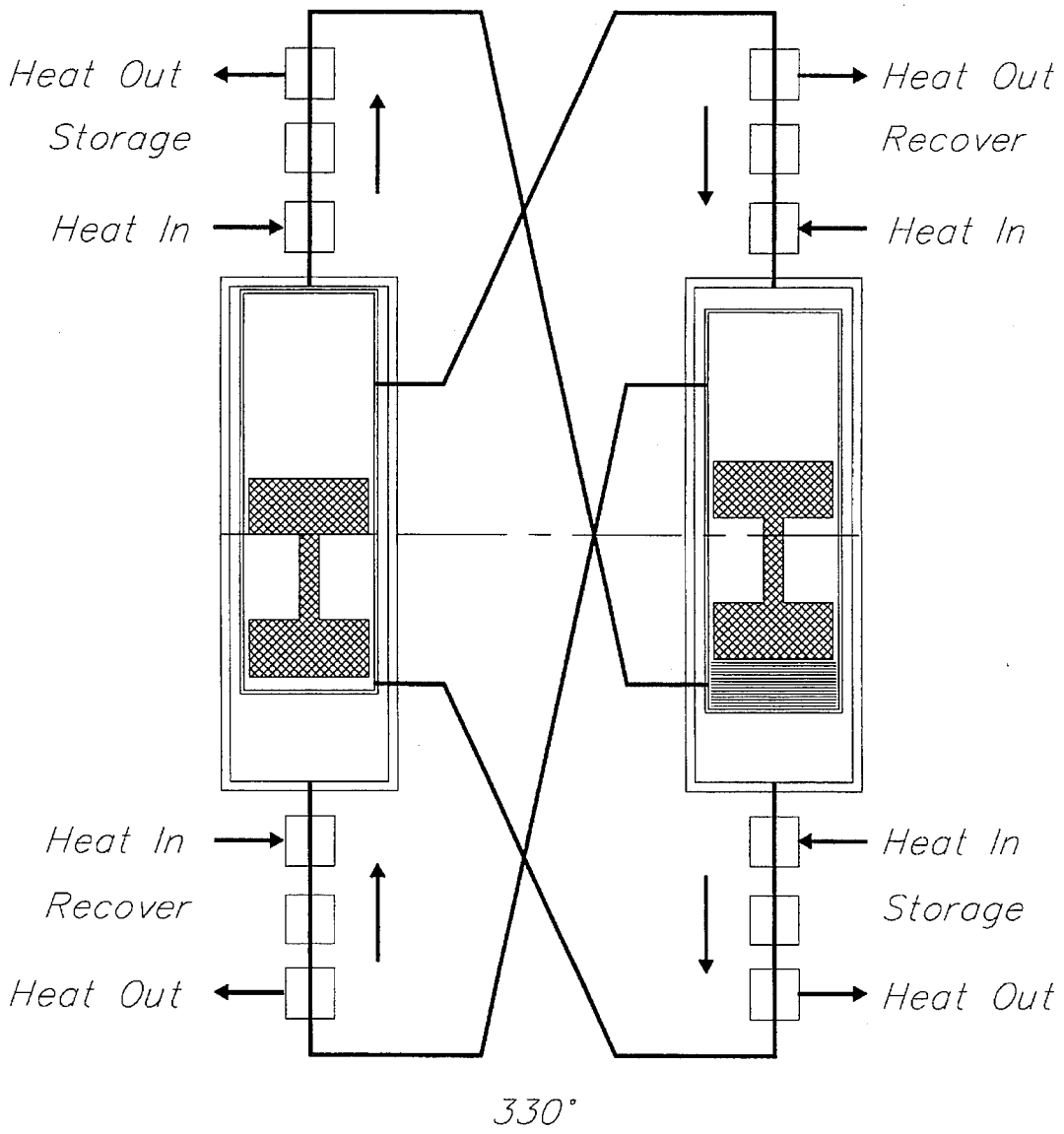
Figure 14A:
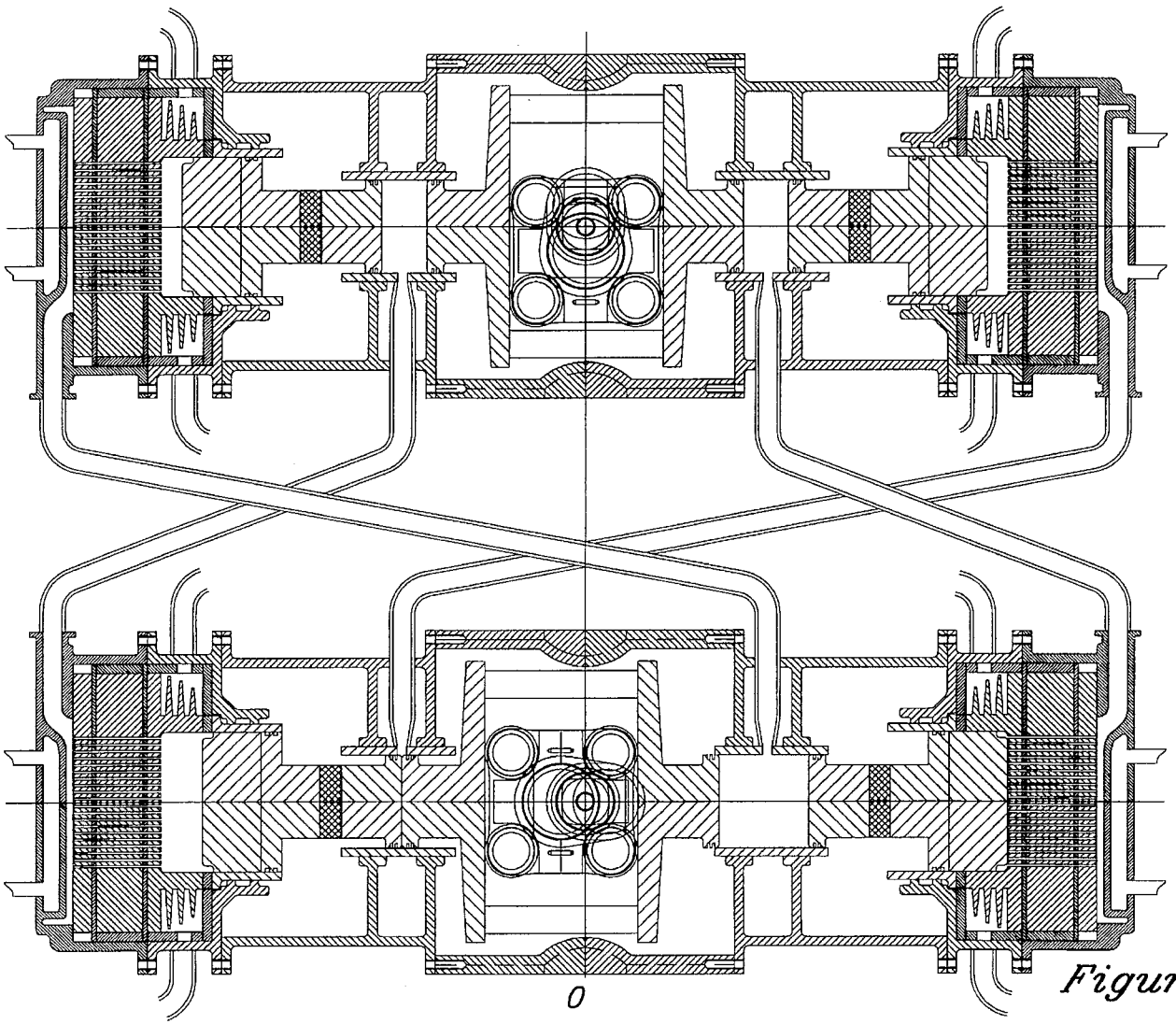
Figure 14B:
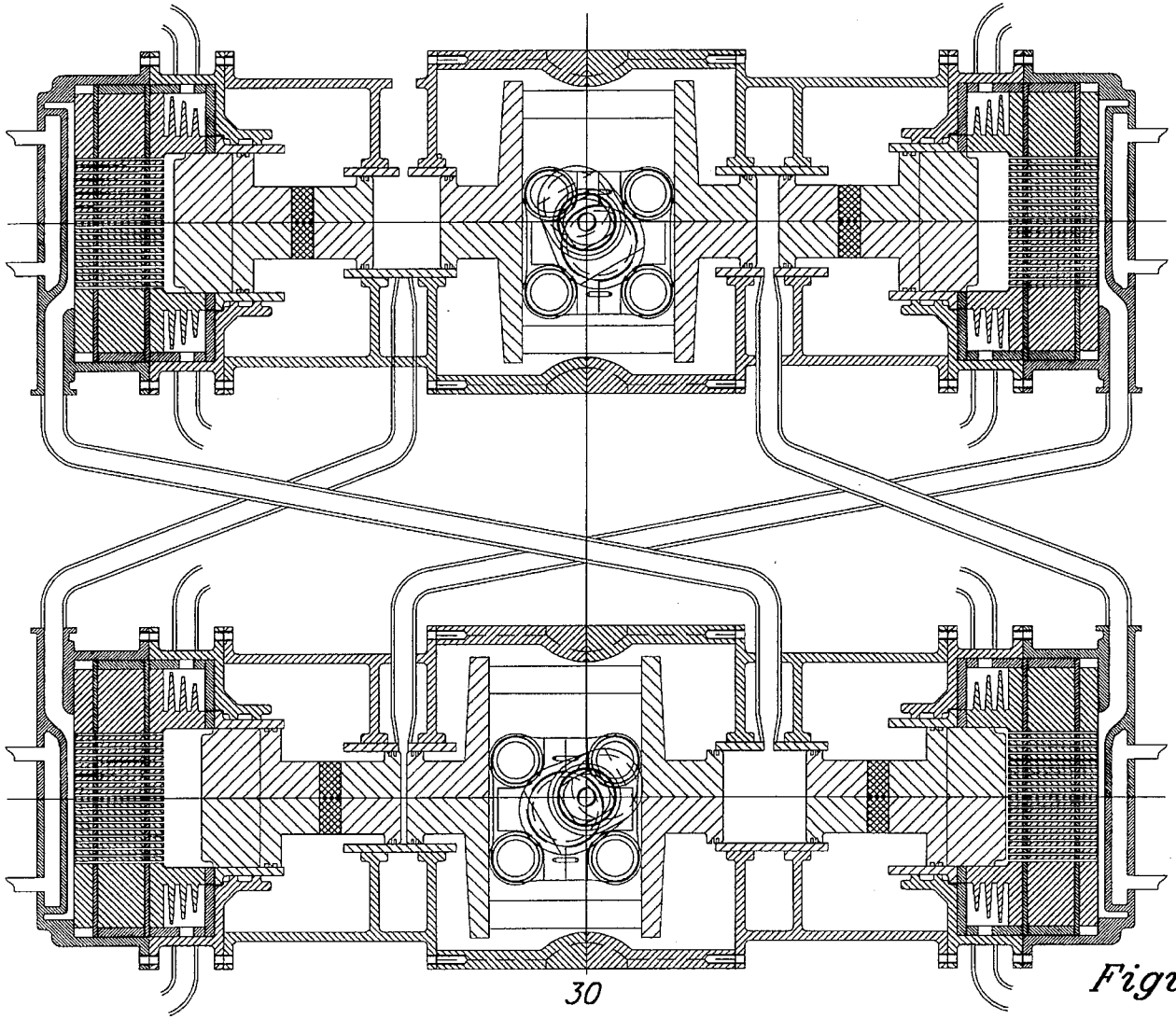
Figure 14D:
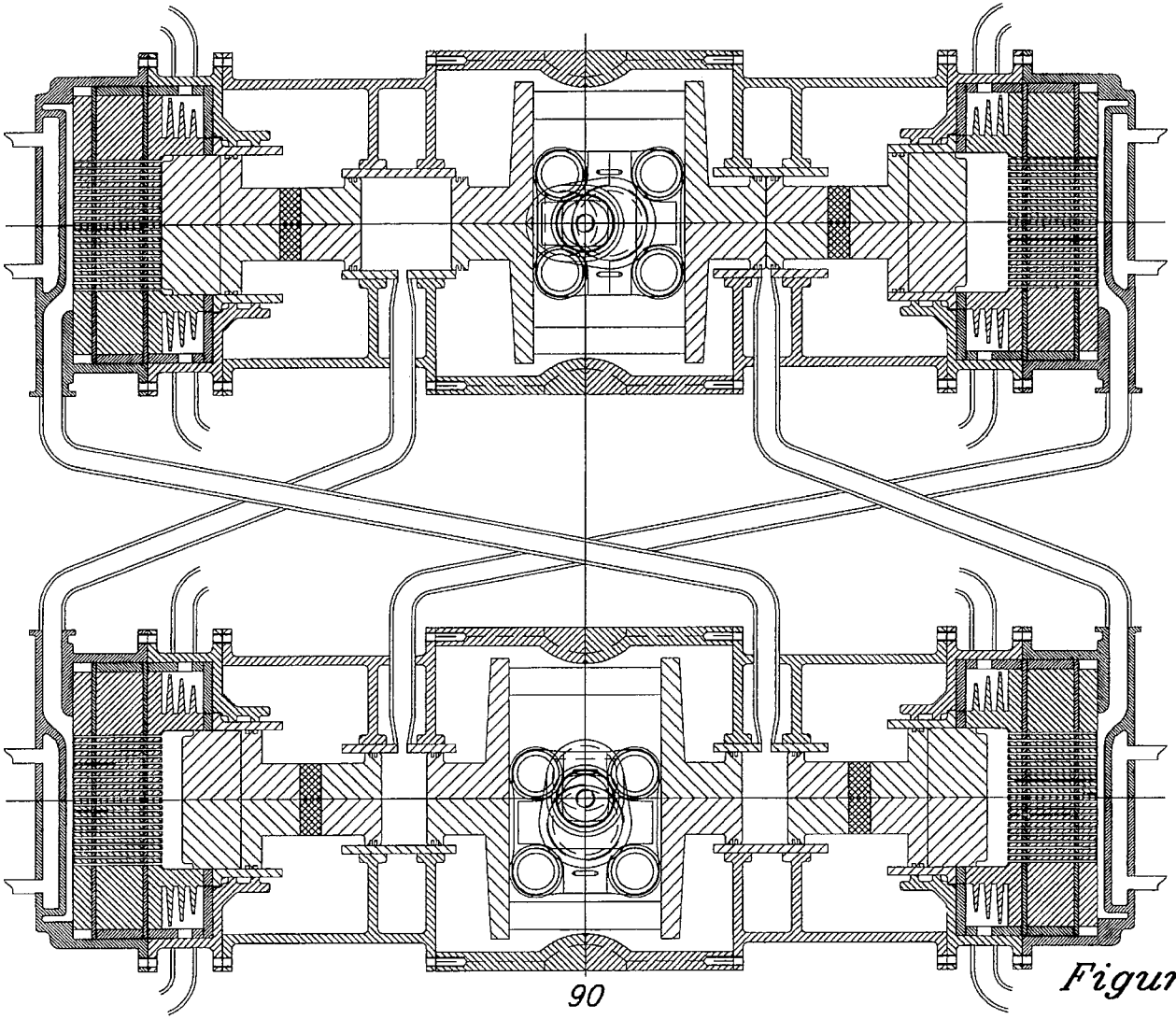
Figure 15A:
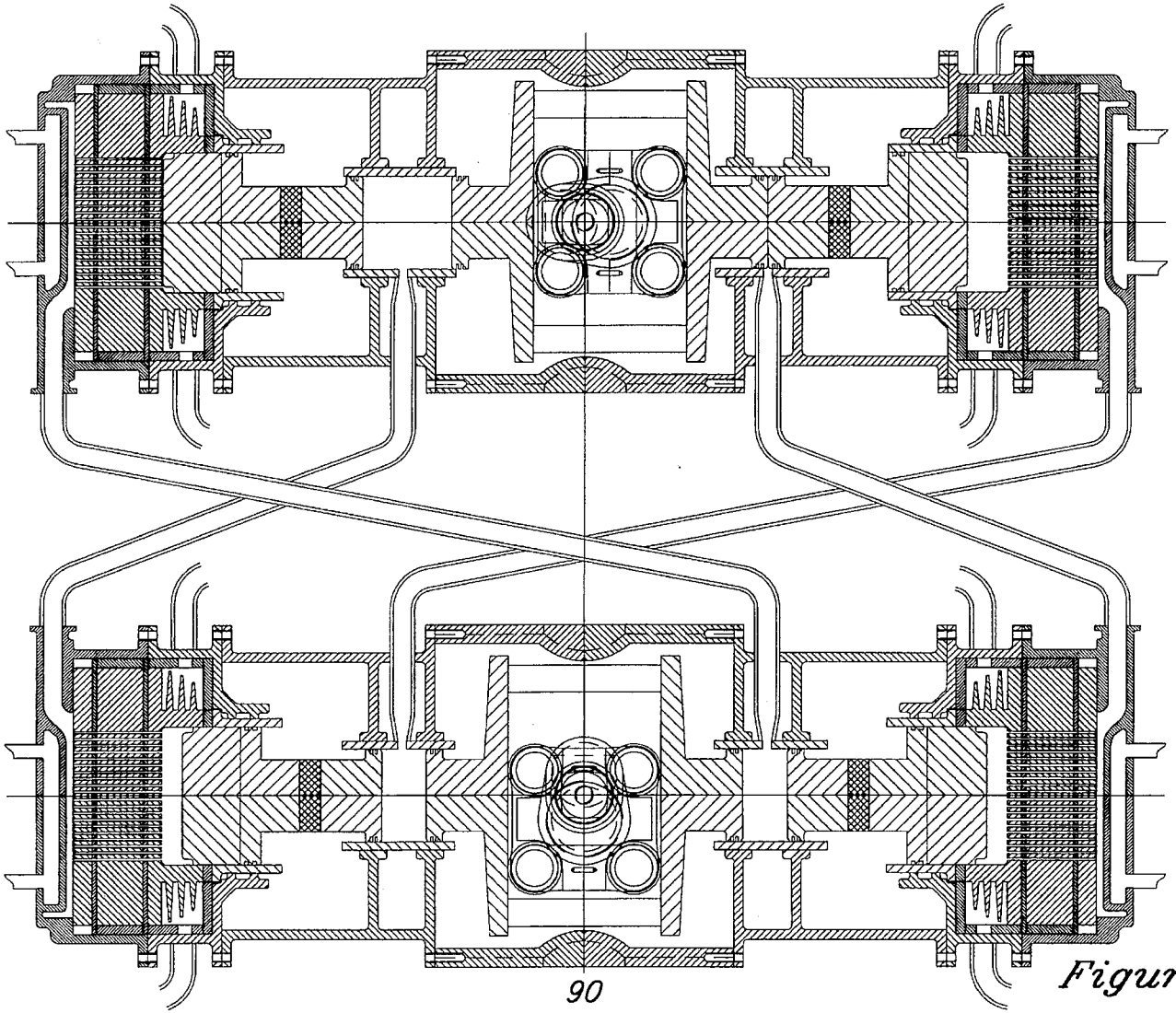
FIGS. 15A –15D are similar to FIG. 14 except that the internal components are shown at crank angles of 90, 120, 150, and 180 degrees positions respectively.
Figure 15B:
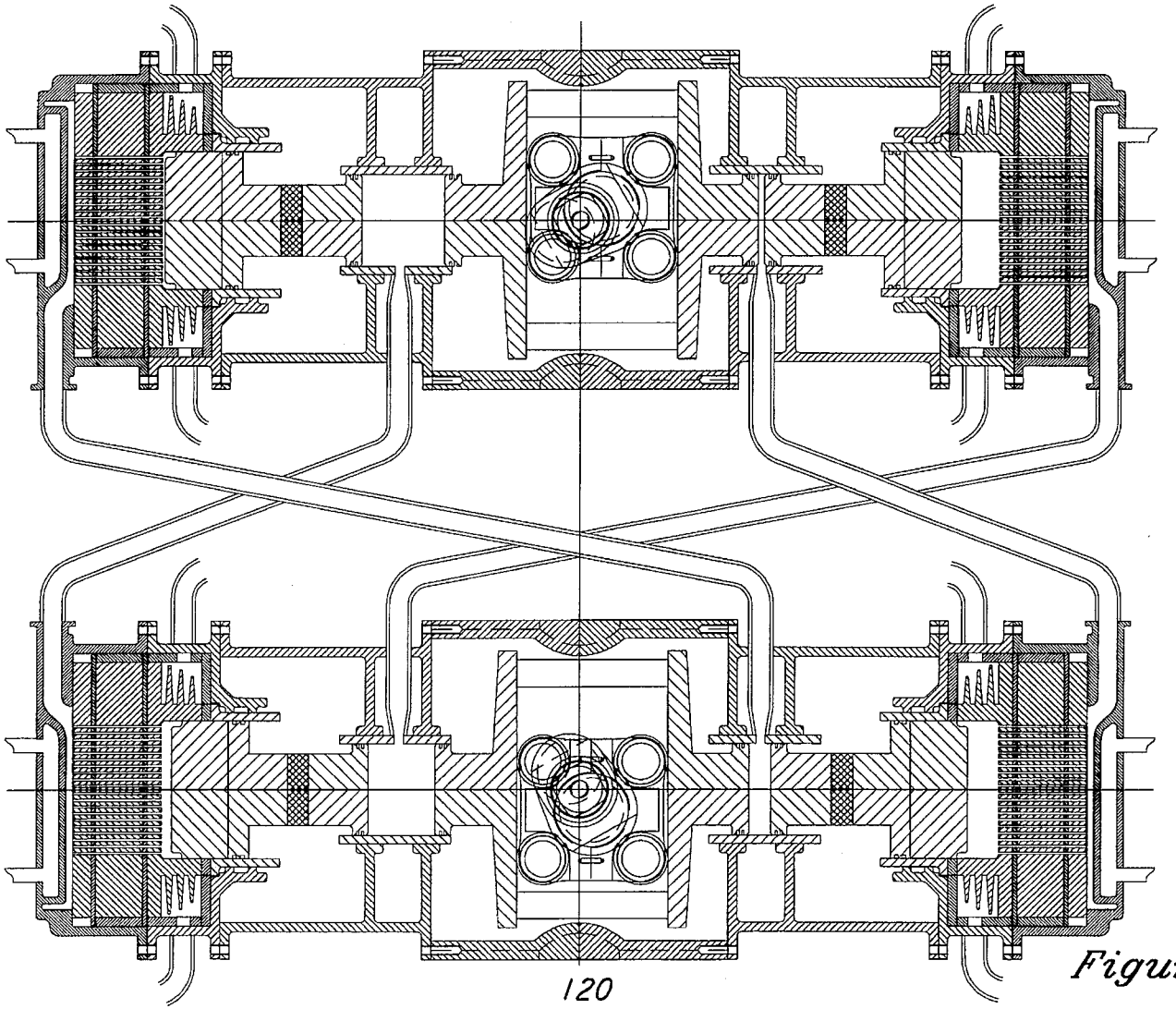
Figure 15C:
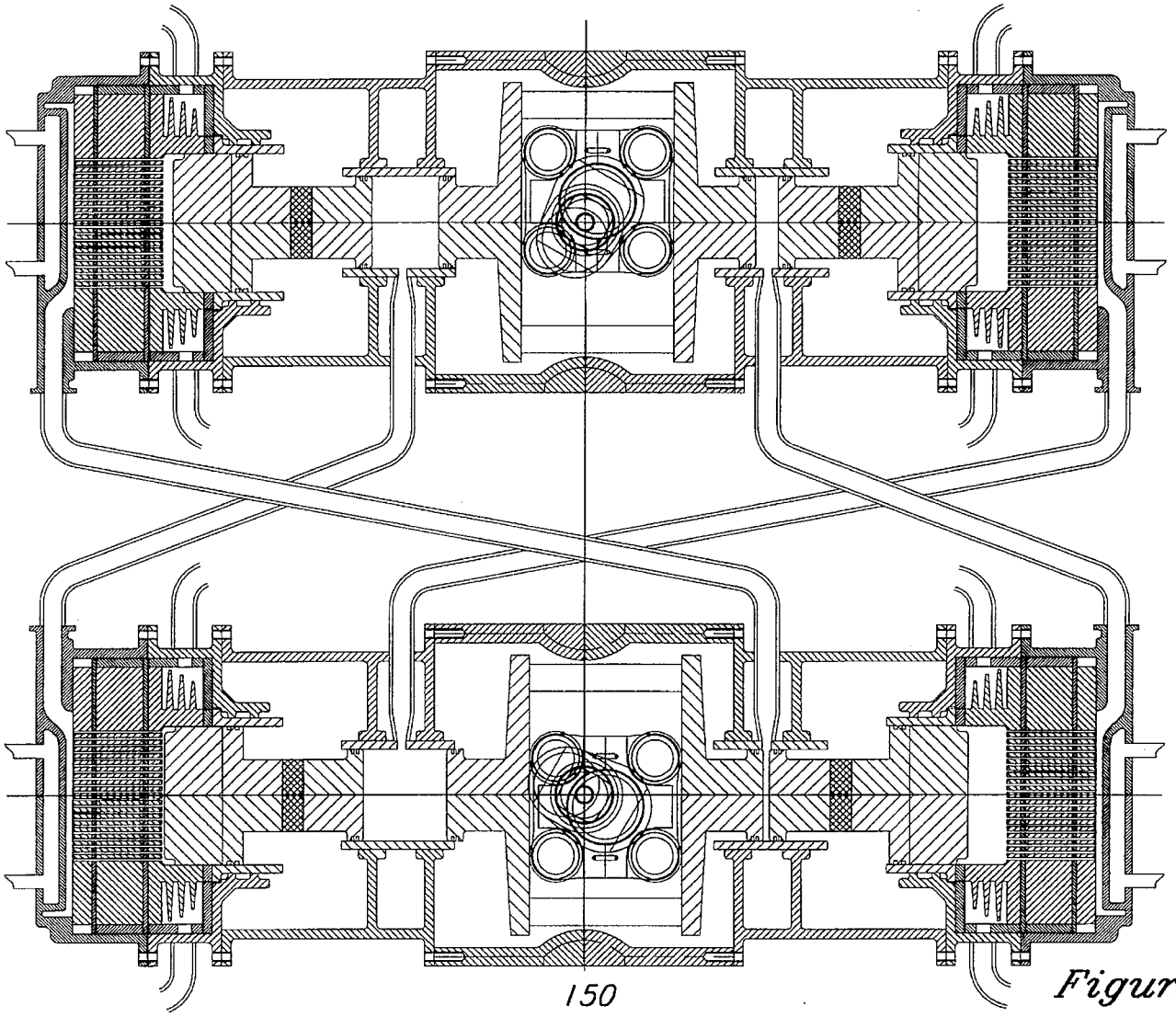
Figure 15D:
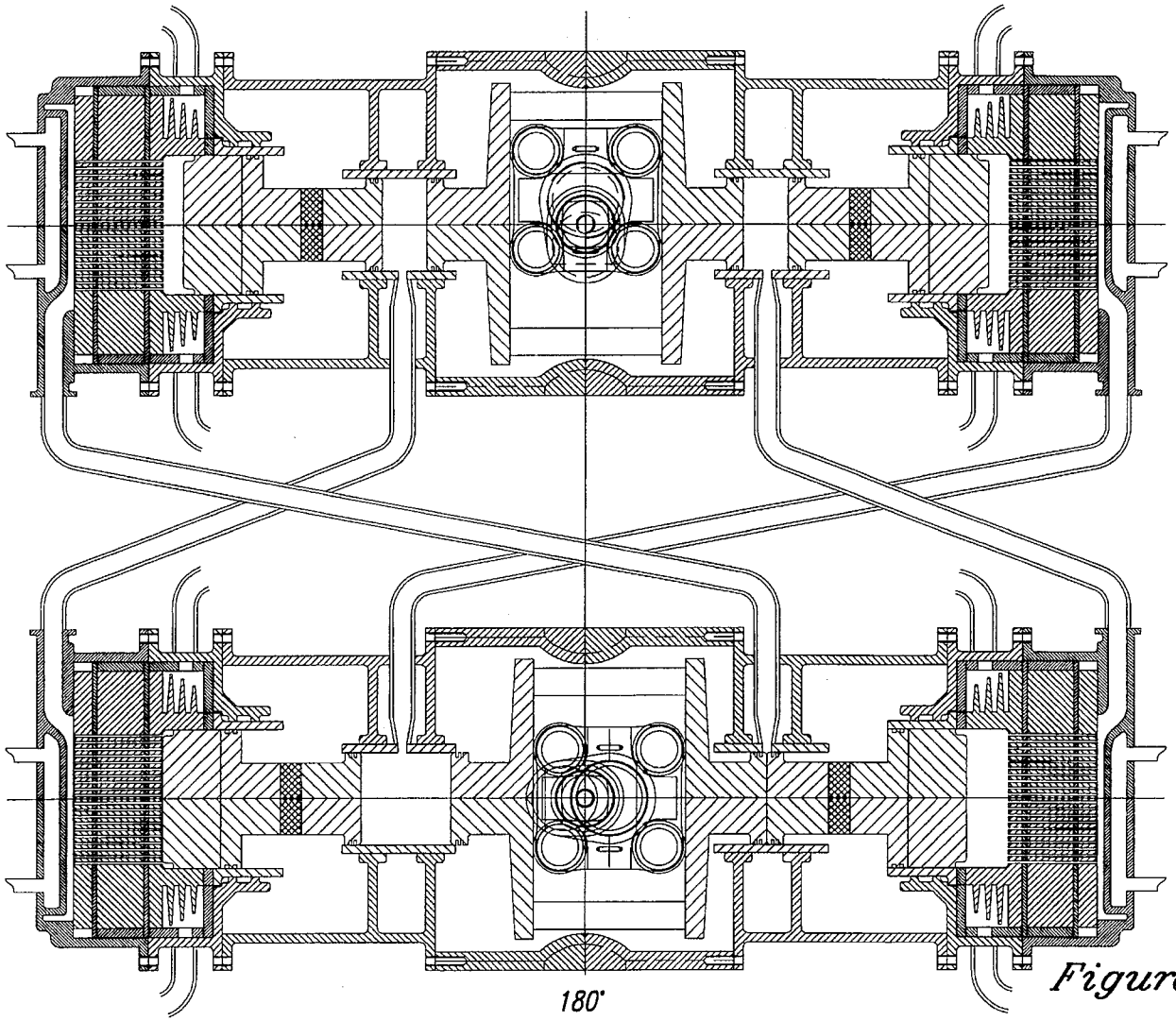

FIG. 9 schematically illustrates a means of alpha engine control by varying the Schmidt phase angle.

The regulation of engine power output is accomplished by a phase angle control device which allows variation of the phase angle between the displacer stroke timing and the power piston timing of a particular alpha subsystem and thus accomplishes nearly instantaneous control of the power output of the engine in a very simple and directly responsive manner. Schmidt phase loop control is accomplished by mechanical means at the crankshaft coupling between two power modules. Two power modules contain four integrated alpha subsystems and each module contains half of each of the four alpha subsystem components. The phase relationship of each of the alpha subsystem components in one of the modules is controlled with respect to the matching alpha subsystem component contained in the other module, by a common Schmidt phase controller connected between the respective module power output shafts. This fourth power output control method may also be coupled with one or more of the three previously mentioned methods to provide complete control in terms of managing the overall fuel efficiency of the engine in response to engine load, speed, and profile constraints. For applications such as stationary ground power units which are not particularly sensitive to size, the simplest means of accomplishing phase angle control is by directly coupling the crankshafts of each power module and using hydraulic actuators to rotate one power module enclosure relative to the mating power module about the crankshaft axis thus effecting chamber in phase angle as a function of actuator position. A gearbox or differential can be used between the crankshafts in place of the direct coupling to accomplish phase angle control for applications where it is not desirable to rotate an entire power module enclosure.

If the phase angle of the couple between the two power modules is near 90 degrees relative to top-dead-center of each module then maximum power output of the total engine can be achieved for a given heat input. If the phase angle is near 0 degrees then the total engine shaft power output will also be near zero since the gas working fluid is merely being pumped from hot chamber to cold chamber with no net work being derived which would also result in more heat rejection for a given heat input. Thus while varying the phase angle gives nearly instantaneous response of the engine the method of controlling the heat input should also be combined to provide an efficient engine in terms of shaft power output for given energy input.

Beta Engines Example

This invention disclosure also teaches that at least two Beta type Stirling cycle subsystems can also be contained in a single power module by employing the same basic structure described above for the alpha configuration except that the crankshaft is modified by positioning the crank pins ninety degrees apart instead of one hundred eighty degrees apart as described above. The heat exchangers, regenerator, and ducts connect the outer volume space of each module half to the inner volume space of the same power module half. A penalty in terms of lack of balanced forces would result in this beta configuration in that during ninety degrees of each cycle the rigidly affixed piston/cylinder assemblies would be thrown in the same direction at the same time resulting in a large mas imbalance. This mass imbalance could be corrected for, of course, by the use of either counter weights on a flywheel or by connecting more than one properly phased beta configured power module to a common crankshaft coupling.

Figure 16A:
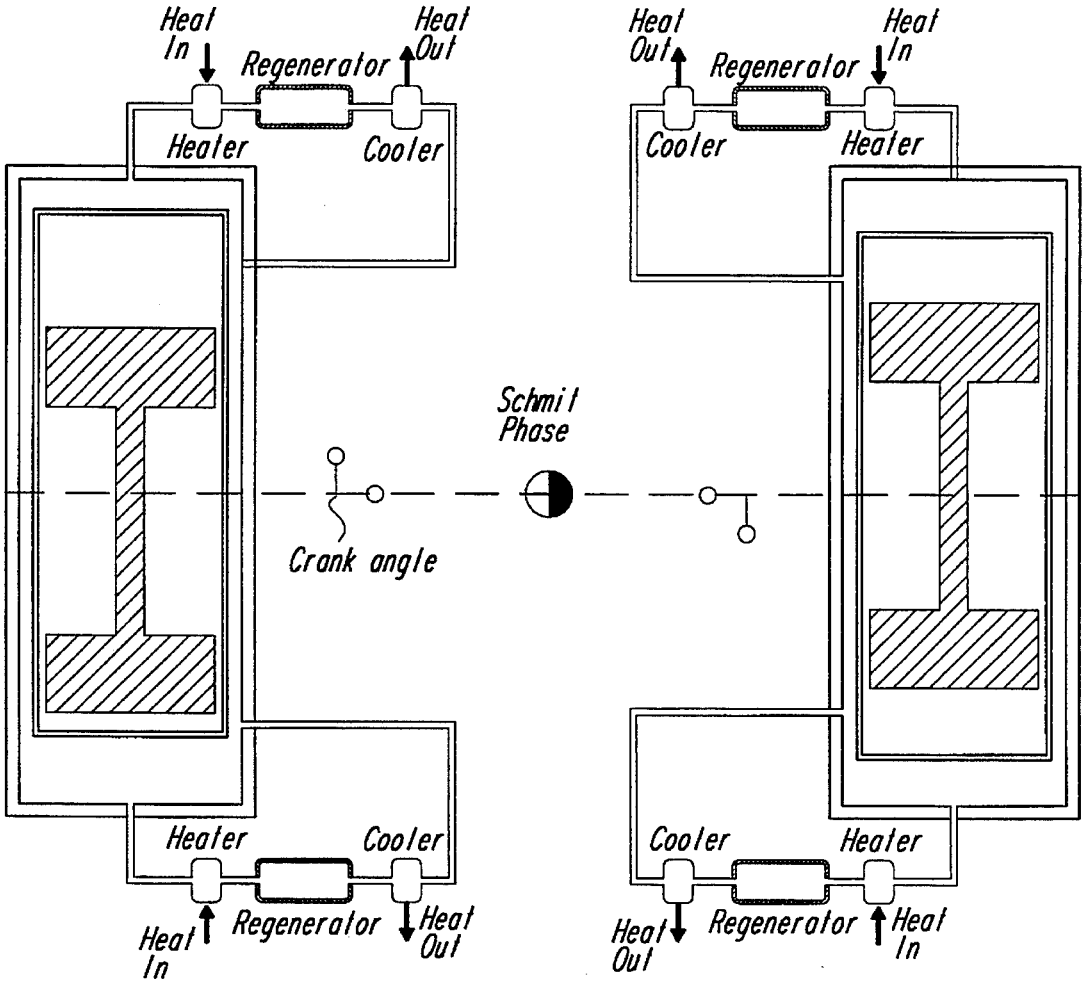
FIGS. 16A –16B are a schematic of the means for interconnecting four beta subsystems to make a balanced compound external heat source regenerative engine using two power modules with 90 degree crankshafts.
Figure 16B:
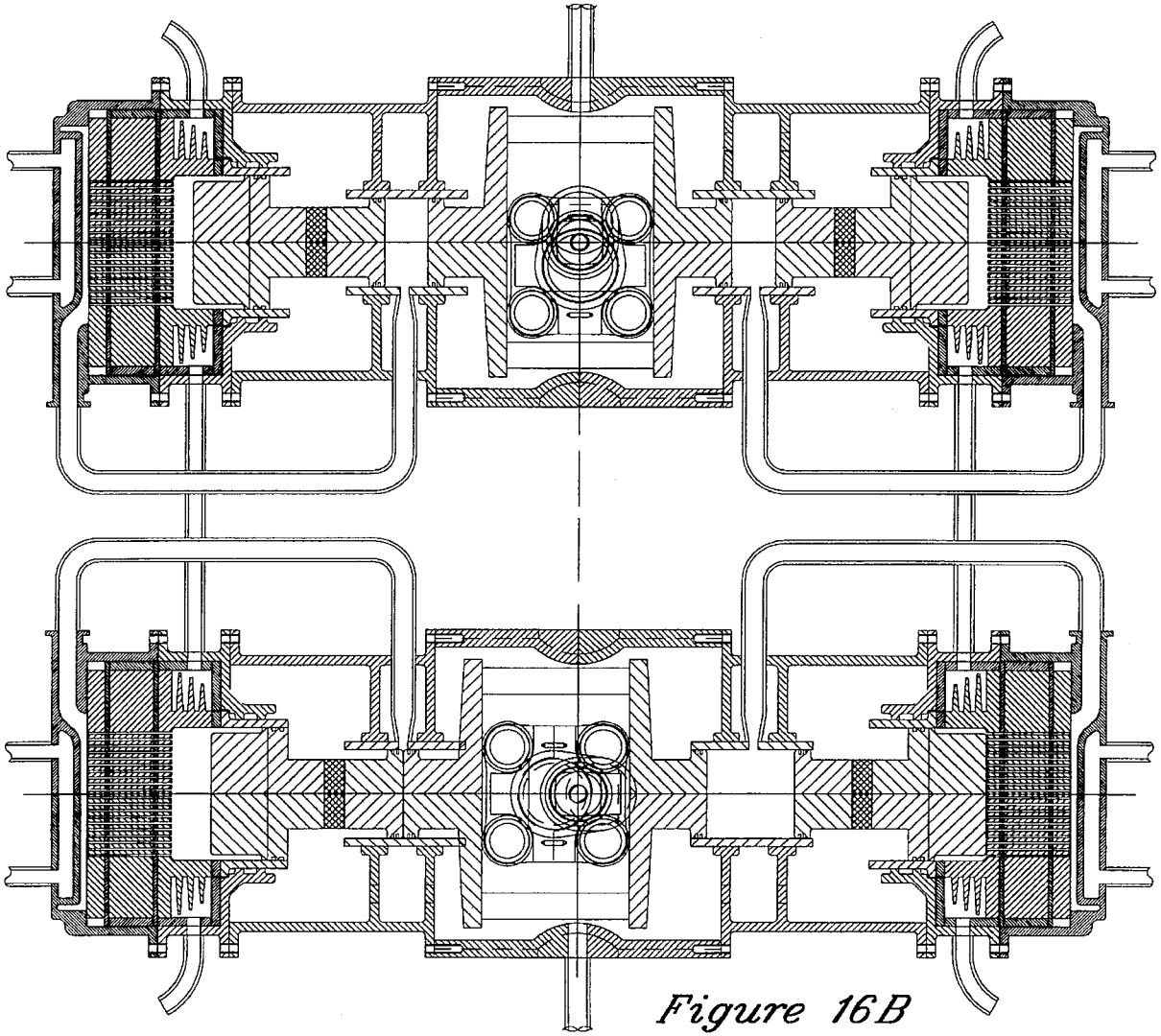

FIGS. 16A –16B schematically depicts a beta configured balanced compound external heat source engine such that each power module contains two beat subsystems. The crankshafts of each power module are phased 180 degrees apart while each inner crankpin is phased only 90 degrees apart from the respective pair of outer crankpins.

This invention further teaches that a balanced compound beta type Stirling engine is also possible by coupling the power output shafts of two beta configured power modules such that the relative phase angle at the shafts is 180 degrees apart. Thus while one piston assembly of one power module is reciprocating one direction the similar piston assembly of the other power module is reciprocating in the opposite direction thus balancing the respective masses about the crankshaft centerline.

Combined Cycles

The telescopic crankcase structure also enables a novel 'combined cycle' configuration combining an air pump, Stirling cycle, diesel cycle, and refrigerator all within one crankcase structure such that each of the four subsystems function simultaneously and harmoniously with each other about a single solid lubricated Scotch-yoke crankshaft. This combined cycle configuration would be very advantageous where the actions of all four cycles are required in a low cost and compact, relatively vibration free structure. The combined cycle configuration is accomplished by attaching multiple pistons to the base of the slide bars comprising the Scotch yoke frame assembly. Up to four pistons can be easily attached to each side of a power module Scotch yoke frame. All pistons attached to the same Scotch yoke frame reciprocate simultaneously in phase relative to each other. The preferred embodiment of this invention is to combine an air compressor with the Stirling cycle to recharge the working gas.

Diesel/Stirling Combustion Compounding

Figure 17:
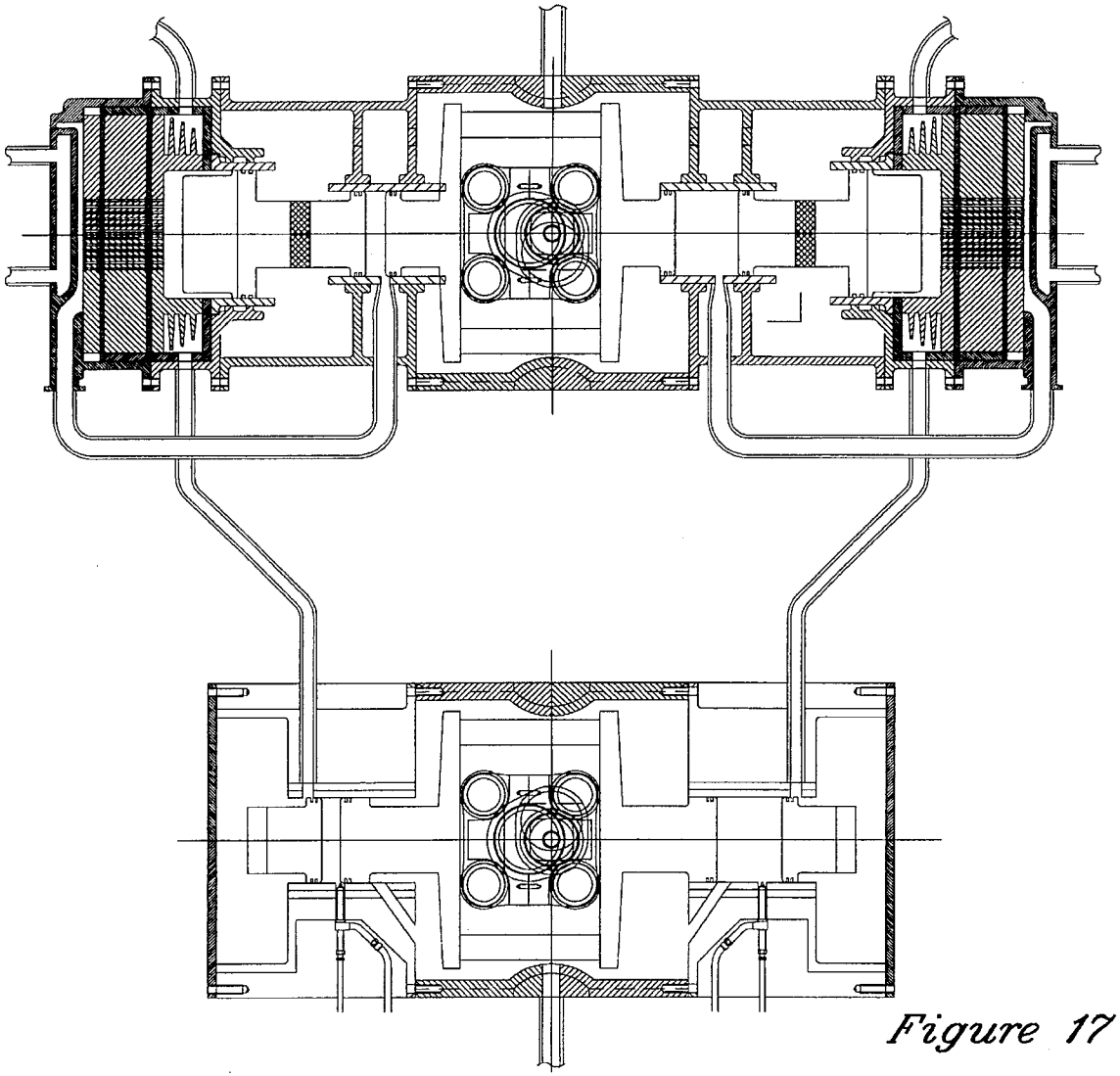
FIG. 17 is a schematic representation of a novel means for combustion compounding coupling the thermal management system of a compound beta Stirling engine to the waste thermal exhaust stream of a diesel engine which is also coupled to the shaft of the Stirling engine providing mass balance and power compounding from two different and simultaneous engine cycles.
Figure 18:
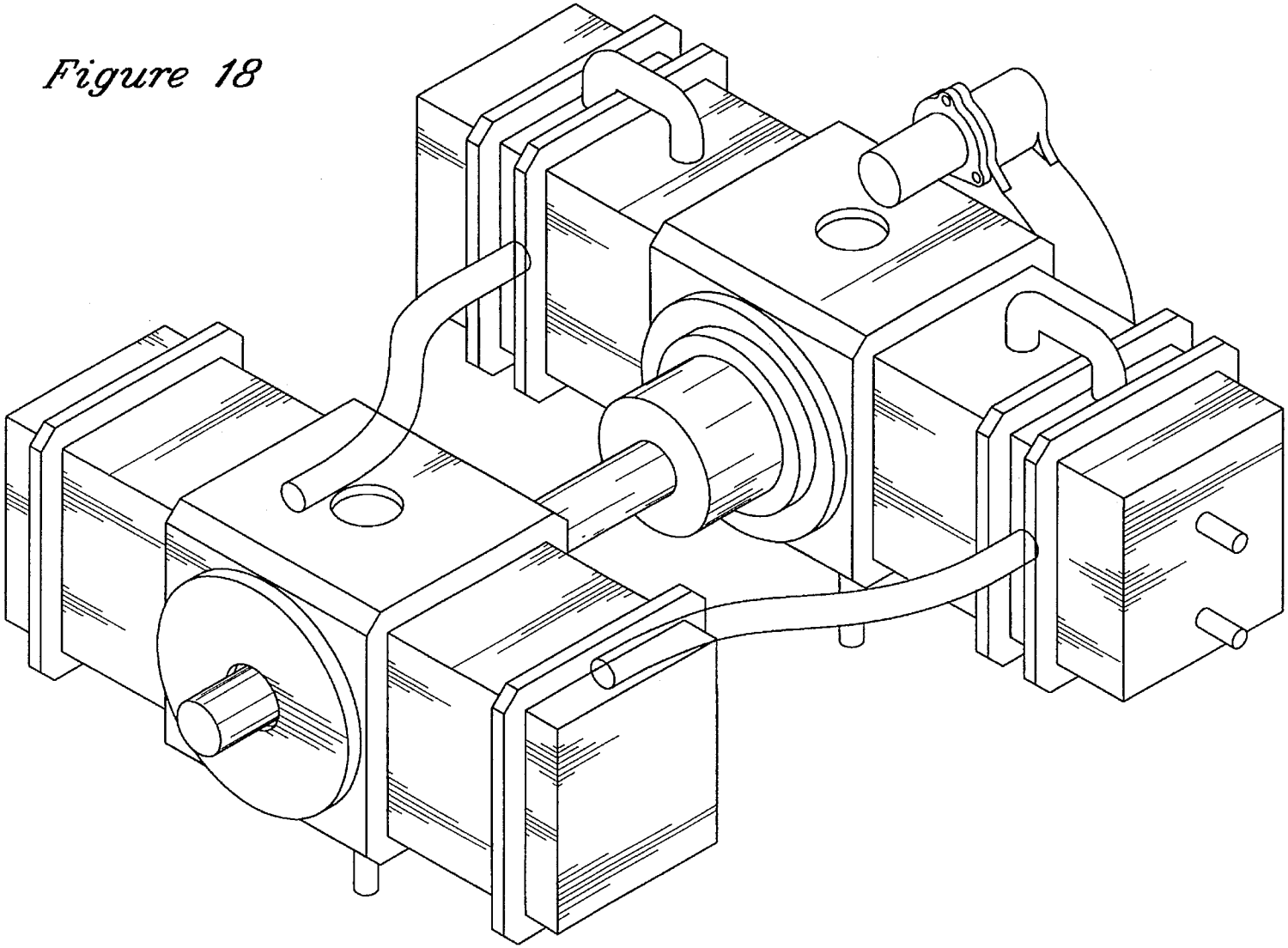
FIG. 18 is an isometric view of the engine of FIG. 17 illustrating the physical envelope and external duct interconnection of diesel/Stirling combustion compounded engine.

FIG. 17 is a schematic representation of a novel means for combustion compounding coupling the thermal management system of a compound beta Stirling engine to the waste thermal exhaust stream of a diesel engine which is also coupled to the shaft of the Stirling engine providing mass balance and power compounding from two different and simultaneous engine cycles;

FIG. 17 of this invention teaches that a novel compounding technique hereafter called "combustion compounding" can be accomplished by directly coupling the power output shafts of a diesel cycle engine and a Stirling engine, and further using the exhaust gases of the diesel engine as the heat source either partially or entirely for the Stirling engine. The combustion compounding principal allows practically any external heat source engine aside from a true Stirling to also be coupled to a internal combustion engine in a similar manner. The advantages of combustion compounding are many as described in the following: from the view point of the diesel engine the external heat source engine adds or compounds power back into the power output shaft as said external heat source engine derives power from the thermal energy available from the hot exhaust gases of the diesel engine resulting in an overall increase in efficiency. From the viewpoint of the external heat source engine the diesel engine is the source of thermal energy supply heat to the thermal management system with the additional effect of adding or compounding power back into the shaft power output of said external heat source engine. The internal combustion engine also provides a means of fast starting the external heat source engine.

The principal of balanced compounding as described by this invention can produce a reciprocating piston engine design which has a relatively constant moment during all points of crankshaft rotation, similar to a low speed rotating turbine. The combination of high torque, very low vibration, and solid lubricated bearing components allows the engines described in this invention to be prime sources of power for a helicopter or tilt wing rotor aircraft and can be operated for long periods in virtually any operating position and further can be directly coupled to the rotors or propellers.

Stirling Turbocompounding

Figure 19:
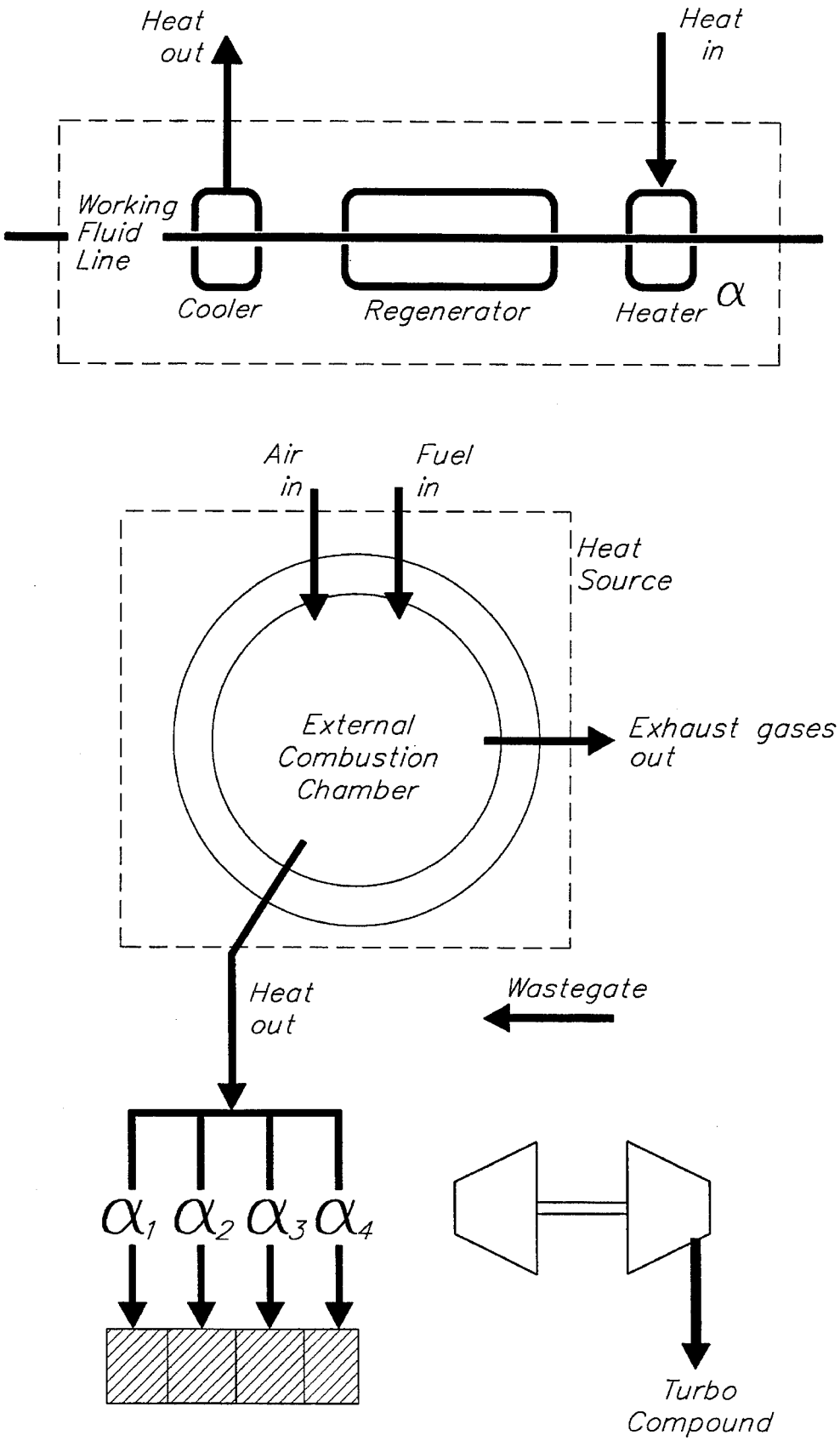
FIG. 19 is a schematic representation of the thermal management system for the balanced compound Stirling engine of FIG. 6 coupled to a means for turbo compounding.

FIG. 19 is a schematic representation of the thermal management system for the balanced compound Stirling engine of FIG. 6 coupled to a means for turbo compounding.

Since heat rejection is an inherent characteristic of the Stirling cycle it would also be advantageous to convert any available waste heat into useful energy by means of a turbocompounding method. The turbocompound method consists of waste heat being channeled into a turbine wheel producing power and the turbine wheel power output shaft then is the either directly or indirectly coupled to the output shaft of the Stirling engine by means of appropriate speed reducers, inertial, and anit-vibration control devices.

Aircraft Turbocompounding

Advanced subsonic aircraft are being designed with fan-props both single and counter-rotating due to inherent efficiency advantage of a properly designed fan-prop over current aircraft turbine engines. The shaft rpm (revolutions per minute) of a large fan-prop (1,900 rpm) is relatively slow compared to the shaft rpm of the conventional turbine engine (50,000 rpm). Thus speed reducing transmissions are required in the use of fan-props being driven by conventional turbine engines. Large reciprocating piston engines are typically designed to operate in the 1,800 to 2,200 rpm range which can result in the elimination of the speed reduction transmission for a fan-prop being directly driven by the shaft power output of a Stirling reciprocating piston engine.

This invention teaches that an efficient means to a fan-prop aircraft can be realized by using a high specific output Stirling external combustion engine such as is described above to directly drive the fan-prop and furthermore coupling the waste heat from the Stirling engine to a conventional reaction thrust turbine engine. The waste heat supplied to the reaction thrust turbine causes the turbine wheel to rotate and generate a reactive thrust as the hot gas expands or exchanges momentum against the turbine wheel blades and produces work as the gas egresses through the various stages of the turbine engine. Thus a form of turbocompounding results in the application of a Stirling engine driving a fan-prop on an aircraft in which the waste heat from the Stirling engine is "turbocompounded" in the sense that the heat energy is converted by a coupled turbine producing more forward thrust for the aircraft by the addition of the reaction thrust of the waste heat turbine and the thrust of the Stirling driven fan-prop.

LN2 Power Boost Method

This invention also discloses a method for temporarily boosting the power output of the Stirling engine by dropping the temperature of the heat rejection exchanger by passing a liquid or gas which is colder than ambient through the heat rejection exchanger or cooling loop. The power increase of the Stirling engine is proportional to the temperature difference between the heat source and the heat sink comparing the effect of the heat source to the heat sink the Stirling engine is more sensitive to the decrease in heat rejection temperature than to the increase in heat intake temperature.

Example: A vehicle powered by a Stirling engine is equipped with a cylinder of liquid nitrogen coupled by lines and control valves to the engine. When the operator of the vehicle demands high acceleration from the engine a valve connected to the cylinder of nitrogen opens and allows liquid nitrogen to blow-down through the boiling evaporator of the heat rejection exchanger. The nitrogen liquid changes to the gas phase as it passes through the heat exchanger and increases in temperature and decreases in pressure. The limit of heat removed from the heat exchanger is determined by the heat capacity, enthalpy of vaporization, and quantity of the cooling has passing through during some time interval. Since the temperature of the heat exchanger can be rapidly decreased the power output of the engine also rapidly increases resulting in the desired acceleration of the vehicle. When the demand for nitrogen ceases the delivery of nitrogen also ceases and the heat rejection exchanger increases in temperature to its previous value with a corresponding decrease in power output of the engine. This method of temporarily reducing the temperature of the heat rejection exchanger can also be combined with the technique of simultaneously increasing the temperature of the heat input exchanger by combustion of more fuel, resulting in an even larger temperature difference and thus more engine power output.

Although I have shown and described a specific embodiment of my invention, it will be apparent that many minor changes of structure and operation could be made without departing from the spirit of the invention as defined by the scope of the appended claims.

I claim:

1. A power module comprising:

a housing unit having a pair of stationary outer cylinders with inner and outer ends;

closing means closing the outer ends of said outer cylinders;

an outer piston unit presenting a pair of outer pistons closing the inner ends of said outer cylinders to define a pair of outer chambers;

a pair of intermediate cylinders fixed against endwise movement relative to one another and each having inner and outer ends;

an inner piston unit having a pair of inner pistons closing the inner ends of said intermediate cylinders, said inner pistons, intermediate cylinders, and outer pistons defining a pair of inner chambers;

reciprocating means for reciprocating said outer piston unit and inner piston unit in respective reciprocating cycles relative to said housing unit and relative to one another to vary the volumes of the inner and outer chambers in each pair of inner and outer chambers relative to one another, the reciprocating cycle of the outer piston unit being out of phase with the reciprocating cycle of the inner piston unit; and porting means in said housing unit and intermediate cylinders for porting said outer chambers and inner chambers, respectively;

said inner piston unit having a slideway midway between said inner pistons, and said outer piston unit having a pair of slideways midway between said outer pistons and located on opposite side of said inner piston unit; and power output means coupled to said reciprocating means and operative in said slideways.

2. A power module according to claim 1 in which said intermediate cylinders are attached to said outer pistons.

3. A power module according to claim 1 in which said intermediate cylinders are attached to said housing unit.

4. A power module according to claim 1 in which said intermediate cylinders are attached to said inner pistons.

5. A power module according to claim 1 in which said power output means comprises bearing blocks slide-mounted in said slideways and mounted on a crankshaft.

6. A power module according to claim 1 in which heating means is provided for heating said outer cylinders.

7. A power module according to claim 1 in which said porting means for said outer chambers is in said closing means.

8. A power module according to claim 1 in which the respective porting means for each of said outer chambers communicates with a respective regenerator.

9. A power module according to claim 1 in which heating means is provided for heating said closing means and said porting means for said outer chambers passes through said closing means.

10. A power module according to claim 9 in which a respective regenerator is mounted on the closing means for each said outer chamber.

11. A power module comprising:

a housing unit having a pair of stationary outer cylinders with inner and outer ends;

closing means closing the outer ends of said outer cylinders;

an outer piston unit presenting a pair of outer pistons closing the inner ends of said outer cylinders to define a pair of outer chambers;

a pair of intermediate cylinders fixed against endwise movement relative to one another and each having inner and outer ends;

an inner piston unit having a pair of inner pistons closing the inner ends of said intermediate cylinders, said inner pistons, intermediate cylinders, and outer pistons defining a pair of inner chambers;

reciprocating means for reciprocating said outer piston unit and inner piston unit in respective reciprocating cycles relative to said housing unit and relative to one another to vary the volumes of the inner and outer chambers in each pair of inner and outer chambers relative to one another, the reciprocating cycle of the outer piston unit being out of phase with the reciprocating cycle of the inner piston unit; and porting means in said housing unit and intermediate cylinders for porting said outer chambers and inner chambers, respectively; said closing means for each said outer chamber comprising a respective sandwich providing a heating plate layer at the outer chamber, a central regenerator layer, and an outer cooling layer, said porting means for said outer chambers passing through said sandwiches; and power output means coupled to said reciprocating means.

12. A power module according to claim 11 in which said porting means for each of said outer chambers is connected to the porting means for the said inner chamber which is most remote whereby two beta engines are formed.

13. A compound alpha engine comprising: a first power module including:

(a) a housing unit having a pair of stationary outer cylinders with inner and outer ends, (b) closing means closing the outer ends of said outer cylinders, (c) an outer piston unit presenting a pair of outer pistons closing the inner ends of said outer cylinders to define a pair of outer chambers, (d) a pair of intermediate cylinders fixed against endwise movement relative to one another and each having inner and outer ends, (e) an inner piston unit having a pair of inner pistons closing the inner ends of said intermediate cylinders, said inner pistons, intermediate cylinders, and outer pistons defining a pair of inner chambers, and (f) reciprocating means for reciprocating said outer piston unit and inner piston unit in respective reciprocating cycles relative to said housing unit and relative to one another to vary the volumes of the inner and outer chambers in each pair of inner and outer chambers relative to one another, the reciprocating cycle of the outer piston unit being about 180° out of phase with the reciprocating cycle of the inner piston unit;

a second power module Like said first power module including four regenerators;

four independent gas conductor means passing through respective of said regenerators and cross-connecting said outer chambers of each said power module with one of said inner chambers of the other said power module to form four alpha engines;

first and second power output means connected respectively to said reciprocating means of said first and second power modules;

and means for establishing a phase differential between said first and second power output means.

14. A compound alpha engine according to claim 13 wherein heat input means is provided for heating gas flowing from said regenerators to said outer chambers.

15. A compound alpha engine according to claim 14 wherein said heat means applies heat to said outer cylinders of said power modules.

16. A compound alpha engine according to claim 14 wherein cooling means is provided for cooling gas flowing from said regenerators to said inner chambers.

17. A compound alpha engine according to claim 13 in which the phase differential between said first and second power output means is about 90 degrees whereby the operating cycles of said four alpha engines are passed about 90 degrees apart.

18. A compound beta engine comprising:

a housing unit having a pair of stationary outer cylinders with inner and outer ends;

closing means closing the outer ends of said outer cylinders;

an outer piston unit presenting a pair of outer pistons closing the inner ends of said outer cylinders to define a pair of outer chambers;

a pair of intermediate cylinders fixed against endwise movement relative to one another and each having inner and outer ends;

an inner piston unit having a pair of inner pistons closing the inner ends of said intermediate cylinders, said inner pistons, intermediate cylinders, and outer pistons defining a pair of inner chambers;

reciprocating means for reciprocating said outer piston unit and inner piston unit in respective reciprocating cycles relative to said housing unit and relative to one another to vary the volumes of the inner and outer chambers in each pair of inner and outer chambers relative to one another, the reciprocating cycle of the outer piston unit being about 90 degrees out of phase with the reciprocating cycle of the inner piston unit;

two regenerators;

two gas conductor means passing through respective of said regenerators and connecting each of said outer chambers to the said inner chamber most remote therefrom to provide two beta engines, and power output means connected to said reciprocating means.

19. A compound beta engine according to claim 18 in which heating input means is provided for heating gas flowing from said regenerators to said outer chambers.

20. A compound beta engine according to claim 19 wherein cooling means is provided for cooling gas flowing from said regenerators to said inner chambers.

21. A compound alpha engine comprising:

a fist power module having (a) a first pair of spaces, (b) a second pair of spaces, (c) first output means for alternately expanding and contracting said first pair of spaces in an inverse sinusoidal relationship relative to one another, and (d) second output means for alternately expanding and contracting said first pair of spaces in inverse sinusoidal relationship to one another and 180 degrees out of phase with said second pair of spaces;

a second power module having (a) a third pair of spaces, (b) a fourth pair of spaces, (c) third output means for alternately expanding and contracting said third pair of spaces in an inverse sinusoidal relationship relative to another which is out of phase with that of said first pair of spaces, and (d) fourth output means for alternately expanding and contracting said fourth pair of spaces in an inverse sinusoidal relationship relative to one another which is 180 degrees out of phase with said third pair of spaces;

four regenerators;

means for cross-connecting said first pair of spaces with respective of said fourth pair of spaces via two of said regenerators to form two alpha engine units;

means for cross-connecting said second pair of spacers with respective of said third pair of spaces via the other two regenerators to form two additional alpha engine units, and variable output means coupling said first and second output means with said third and fourth output means such as to selectively simultaneously vary the phase relationship of said first and second pair of spaces relative to said third and fourth pair of spaces.

* * * * *

UNITED STATES PATENT AND TRADEMARK OFFICE

CERTIFICATE OF CORRECTION

PATENT NO. : 5,456,076
DATED : October 10, 1995
INVENTOR(S) : Bruce L. Zornes

It is certified that error appears in the above-indentified patent and that said Letters Patent is hereby corrected as shown below:

On the cover page, under the heading "ABSTRACT", in the second line of the abstract, before "by" and after "is", please delete "mad" and insert therefor --made--.

In column 17, claim 13, lines 12 and 13, after "comprising:", please begin a new line for "a first power module including:".

In column 17, claim 13, line 41, please delete "Like" and insert therefor --like--.

In column 18, claim 21, line 63, please delete "spacers" and insert therefor --spaces--.

Signed and Sealed this

Twentieth Day of February, 1996

*Attest:*

Bruce Lehman

BRUCE LEHMAN

*Attesting Officer*

*Commissioner of Patents and Trademarks*